US006665956B2

(12) United States Patent
Hay

(10) Patent No.: US 6,665,956 B2
(45) Date of Patent: Dec. 23, 2003

(54) FOOT GUIDED SHOE SOLE AND FOOTBED

(76) Inventor: Gordon Graham Hay, 89 Elm Rd., Newtonville, MA (US) 02160

( * ) Notice: Subject to any disclaimer, the term of this patent is extended or adjusted under 35 U.S.C. 154(b) by 0 days.

(21) Appl. No.: 10/156,577

(22) Filed: May 24, 2002

(65) Prior Publication Data

US 2002/0144428 A1 Oct. 10, 2002

Related U.S. Application Data

(62) Division of application No. PCT/US02/05709, filed on Feb. 20, 2002.

(60) Provisional application No. 60/323,298, filed on Sep. 18, 2001.

(30) Foreign Application Priority Data

Feb. 21, 2001 (IT) ..... MI2001A0351

(51) Int. Cl.[7] ..... A43B 13/00

(52) U.S. Cl. ..... 36/25 R; 36/30 R; 36/31; 36/142

(58) Field of Search ..... 36/43, 44, 35 R, 36/37, 25 R, 30 R, 31, 142, 143, 144

(56) References Cited

U.S. PATENT DOCUMENTS

| | | | | | |
|---|---|---|---|---|---|
| 4,120,102 | A | * | 10/1978 | Kenigson | 36/71 |
| 4,268,980 | A | | 5/1981 | Gudas | 36/43 |
| 4,364,189 | A | * | 12/1982 | Bates | 36/31 |
| 4,435,910 | A | * | 3/1984 | Marc | 36/44 |
| 4,506,460 | A | * | 3/1985 | Rudy | 36/28 |
| 4,510,700 | A | | 4/1985 | Brown | 36/44 |
| 4,615,126 | A | | 10/1986 | Mathews | 36/102 |
| 4,616,431 | A | * | 10/1986 | Dassler | 36/28 |
| 4,619,056 | A | | 10/1986 | Lin et al. | 36/43 |
| 4,776,109 | A | | 10/1988 | Sacre | 36/3 B |
| 4,800,657 | A | * | 1/1989 | Brown | 36/44 |
| 4,843,741 | A | * | 7/1989 | Yung-Mao | 36/114 |
| 4,879,821 | A | | 11/1989 | Graham et al. | 36/44 |
| 4,908,962 | A | * | 3/1990 | Yung-Mao | 36/28 |
| 5,014,706 | A | * | 5/1991 | Philipp | 36/140 |
| 5,297,349 | A | * | 3/1994 | Kilgore | |
| 5,311,680 | A | * | 5/1994 | Comparetto | 36/154 |
| 5,493,791 | A | * | 2/1996 | Kramer | 36/28 |
| 5,647,145 | A | | 7/1997 | Russell et al. | 36/28 |
| 5,669,162 | A | | 9/1997 | Dyer | 36/44 |
| 5,786,057 | A | * | 7/1998 | Lyden et al. | 428/52 |
| 5,937,544 | A | | 8/1999 | Russell | 36/28 |
| 5,964,046 | A | | 10/1999 | Brooks | 36/28 |
| 6,065,230 | A | * | 5/2000 | James | 36/25 R |
| 6,131,311 | A | | 10/2000 | Brown et al. | 36/43 |
| 6,199,302 | B1 | | 3/2001 | Kayano | 36/28 |
| 6,199,303 | B1 | | 3/2001 | Luthi et al. | 36/31 |

* cited by examiner

*Primary Examiner*—M D Patterson
(74) *Attorney, Agent, or Firm*—Davis & Bujold PLLC

(57) ABSTRACT

An inner sole assembly for a shoe. The inner sole assembly comprises an upper body with an upper surface for engaging with a foot of a wearer. A foot bed composite supporting the lower surface of the upper body, and the foot bed composite comprising at least a heel portion and an arch portion. The heel portion of the foot bed composite provides lift to the heel portion to assist with introducing forward motion of a foot of the wearer. The heel portion of the foot bed composite typically has a plurality of protrusions projecting from a bottom surface of the foot bed composite for engagement with a outer sole of the shoe. The inner sole assembly may also include a frame assembly and a canting assembly.

35 Claims, 19 Drawing Sheets

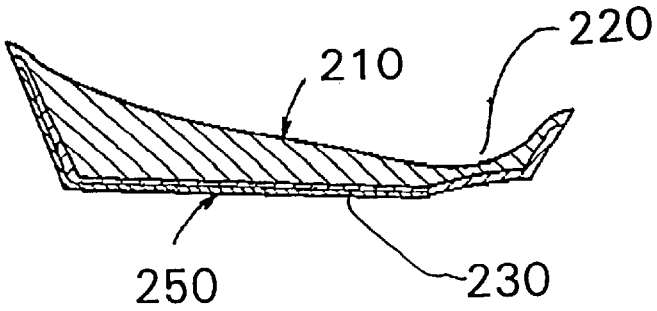
Fig. 12
Fig. 13
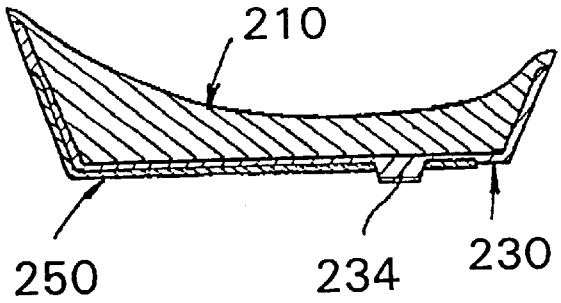
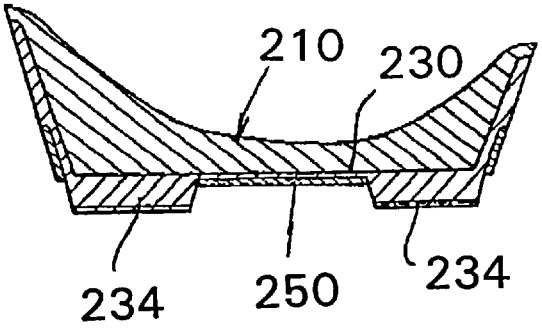
Fig. 14
Fig. 15
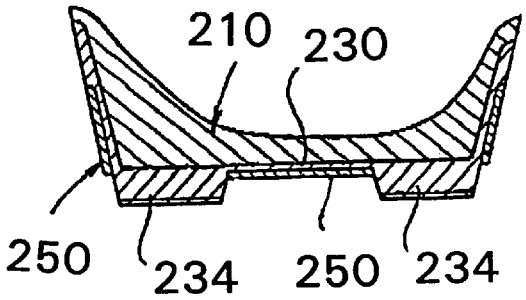

FOOT GUIDED SHOE SOLE AND FOOTBED

This application is a division of PCT/US02/05709 filed Feb. 20, 2002 which claims benefit of Provisional No. 60/323,298 filed Sep. 18, 2001.

FIELD OF THE INVENTION

This invention relates to shoe soles and, more specifically, to an inner shoe sole that is structured to react to movement by the wear's foot.

BACKGROUND OF THE INVENTION

Shoe soles are well known in the prior art. Modern shoe soles include many layers, e.g., an outer sole, an middle sole and an inner sole. Typically, there is a rubber outer layer that is structured to contact and engage the ground. This layer has a bottom face that includes a tread or a plurality of protrusions. The rubber outer layer has an upper face that contacts an inner layer. The inner layer typically includes one or more layers of padding. The inner layer may be shaped, e.g., have an arch support. The inner layer, however, is not structured to react to movement occurring within the foot and be guided by the foot during walking.

The human foot is a complex machine of bone linked by a matrix of ligaments and tendons. As a person walks, the foot performs complex actions to stabilize the body and move the body in the desired direction. For example, a runner's bare or naked foot structure naturally adjusts or conforms its shape to provide balance for the body on the soft beach to the inclined variables of the terrain. The internal structure moves its complex matrix and adjusts its shape to work in opposing planes in motion. The moving structure alters the shape of multiple arches. This changes multiple structural functions that suspend, lock, and lever toe extensions along transverse, sagittal and frontal planes. However, the ability of the structure to move along multiple planes is limited and altered by manmade footwear. Much of the natural movement is lost do to the opposing shoe structures.

Prior art soles are not structured to react to the above noted foot motions. That is, the foot will perform such motions which result in the foot moving within the shoe, but not affecting either the inner or outer layer of the sole. Thus, while the foot is in the air, the motions of the foot are, essentially, lost. While the foot is in contact with the ground, the foot is forced to react to the non-responsive sole. That is, conventional shoe soles guide the foot away from the natural function of the foot.

There is, therefore, a need for a sole assembly that is structured to react to and be responsive to the foot. That is, there is a need for a shoe sole that is guided by the foot instead of the foot being guided by the sole.

There is a further need for a sole assembly that has a outer sole assembly and a replaceable reactive upper sole assembly, having a variety different configurations, to suit the needs of the specific wear's foot.

SUMMARY OF THE INVENTION

The above and other needs are met by the present invention which provides a sole assembly that includes a outer sole assembly and a reactive upper sole assembly. The reactive upper sole assembly is structured to react to movements by and within the wear's foot. These movements are translated by the reactive layer to movement between the reactive upper sole and the outer sole. That is, both the outer sole and the reactive upper sole have a plurality of contact or engagement points. These contact or engagement points may be: (1) two or more protrusions, (2) a protrusion and a void, or (3) two or more voids, soft areas, or areas of different resiliency. Depending on how the foot of a specific user moves, these engagement points are activated. Thus, the outer sole assembly, reacting to and in response to the reactive upper sole assembly, is changed. That is, the upper and outer sole assembly, according to the present invention, facilitate a sole in which the foot guides the sole instead of the sole guiding the foot.

The protrusions on the lower surface of the outer sole, e.g., the tread of the sole, can be programmed or designed for gripping, braking and guidance. That is, by having the external protrusions shaped or angled in desired directions, different tread functions may be accomplished. The external protrusions cooperate with the reactive upper sole assembly. For example, the outer sole, may have a hollow downward protrusion below the big toe, that is structured to engage with the ground. A void is provided within the protrusion. The reactive upper layer also includes a downward protrusion which, when the foot is at rest, is disposed above the void. When the user begins to take a step forward, pressure is applied by the big toe forcing the protrusion of the reactive upper sole into the void provided in the hollow outer sole protrusion. Thus, the protrusion in the outer sole becomes rigid and provides a strong lift off point for the foot. Alternatively, the user could take a step backward. Here the big toe does not force the active upper sole protrusion into the void or hollow outer sole protrusion. The external protrusions do not become rigid and the outer sole does not interfere with the normal gait cycle of the individual. In other words, the reactive upper sole acts similar to a claw on a cat which may be extended or retracted, as necessary. This action is controlled by the individual's foot, not the sole.

Thus, the reactive upper sole can be programmed or designed to change the operating characteristics of the outer sole. By way of another example, the reactive upper sole can be programmed or designed to engage the outer sole depending on the task being performed. That is, if the user is climbing a steep hill, the reactive upper sole can be programmed or designed to engage the outer sole so that pressure from the big toe causes the external protrusions to move downward at an angle to provide a strong or better grip for the outer sole. On a less steep hill, the reactive upper sole may cause the external protrusion to be locked in place, without moving downward. On a decent, the reactive upper sole may not engage the outer sole and thus the external protrusion remains flexible. Similarly, the external heel protrusions can be programmed or designed to be engaged by the reactive upper sole when braking of the sole is required. That is, the external protrusions can be made rigid and forced to move downward at preprogrammed or designed angles.

The term "downward", as used in this application, means to move generally in direction perpendicularly toward an outer most surface of an outer sole and the term "upward", as used in this application, means to move generally in direction perpendicularly away from the outer most surface of the outer sole.

BRIEF DESCRIPTION OF THE DRAWINGS

A full understanding of the invention can be gained from the following description of the preferred embodiments when read in conjunction with the accompanying drawings in which:

FIG. 12 is diagrammatic cross-sectional view along section line 12—12 of FIG. 2;

FIG. 13 is diagrammatic cross-sectional view along section line 13—13 of FIG. 2;

FIG. 14 is diagrammatic cross-sectional view along section line 14—14 of FIG. 2;

FIG. 15 is diagrammatic cross-sectional view along section line 15—15 of FIG. 2;

DETAILED DESCRIPTION OF THE INVENTION

Figure 1:
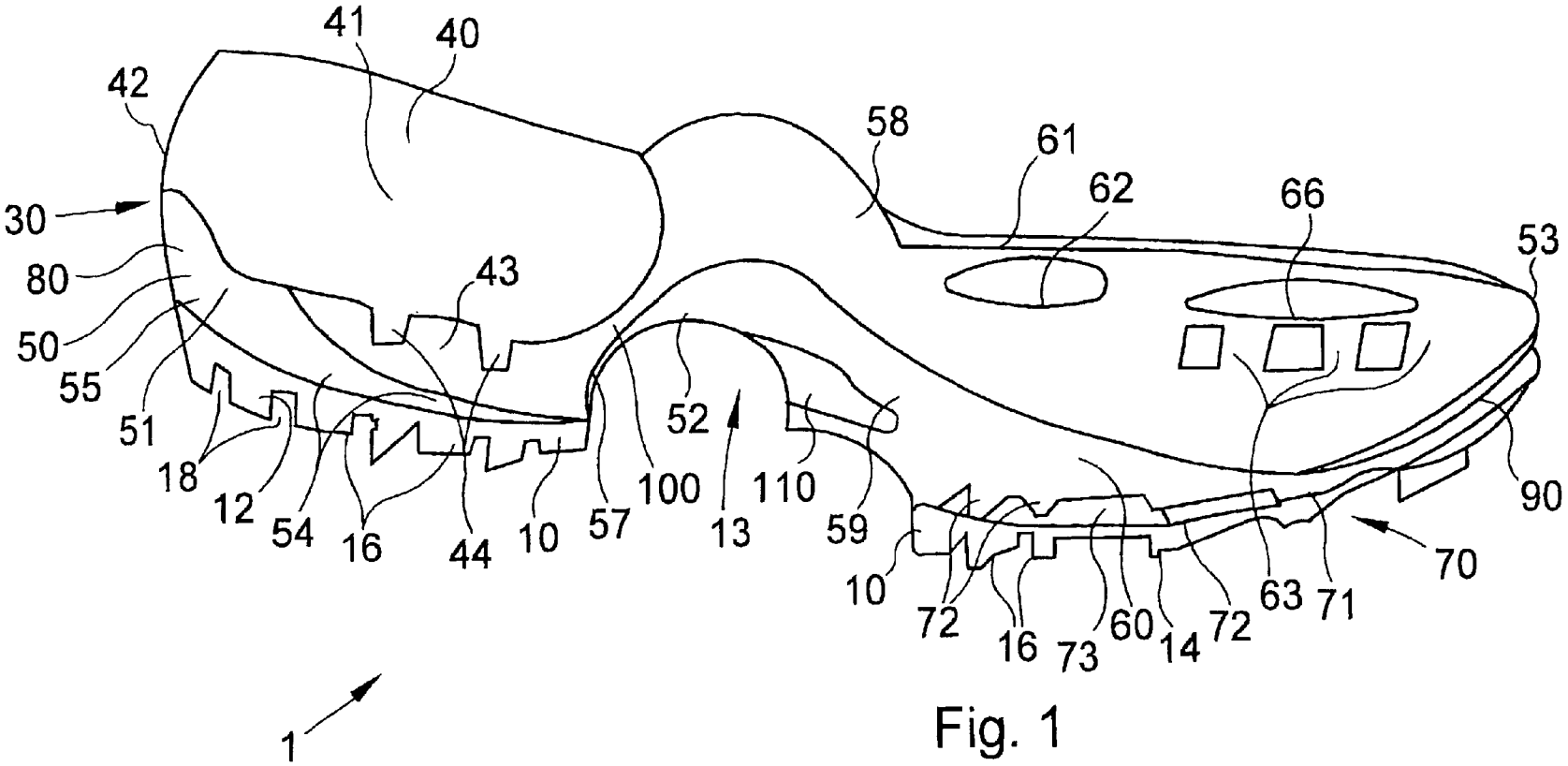
FIG. 1 is a diagrammatic perspective view showing the various components comprising a first embodiment of the inner sole assembly according to the present invention.

As shown in FIG. 1, a shoe sole assembly 1 includes a outer sole assembly 10 and a reactive upper sole assembly 30. The elongate side of the sole 1 that is structured to contact a users big toe is referred to as the "inner" side of the sole 1, and the elongate side of the sole that is structured to contact the users little toe is referred to as the "outer" side. As shown in FIG. 1, the outer sole assembly 10 is divided into a heel portion 12 and a forward portion 14. An arch portion 13 is located between the heel portion 12 and the forward portion 14. The outer sole assembly 10 may be a continuous member from the heel portion 12 to the front portion 14. As is well known in the art, the outer sole assembly 10 is typically manufactured from a flexible material, or combinations of materials, such as rubber, EVA, nylon, TPU, TPR, or urethane. The bottom ground engaging surface of the outer sole assembly 10 includes a plurality of protrusions 16. The protrusions 16 are divided or separated by grooves 18, thus forming a tread, as is well known in this art. The protrusions may be solid or hollow depending upon the particular application at hand.

A bottom surface of the reactive upper sole 30 is coupled to a top surface of the outer sole 10. The reactive upper sole 30 is structured to react to movements by and within the wear's foot, as will be described in further detail below. The reactive upper sole 30 includes a first frame 40, a second frame 50, and a third frame 70. The first frame 40 and the third frame 70 may be joined for lever functions or linked by a resilient layer for moving function. The first frame 40, the second frame 50 and the third frame 70 are each made from materials such as TPU, nylon or polyurethane. The material can be made rigid or semi-rigid as required. The first frame 40, a second frame 50, and a third frame 70 are linked directly to each other or held in a spaced relation by a low compression material such as TPU, TPR, rubber or EVA, as described below.

The first frame 40 extends generally over the outer sole heel portion 12. The first frame 40 includes a generally flat body 41, and inner posterior cap 42, and outer interior cap 43, and a plurality of rigid or semi-rigid protrusions 44 which extend downwardly.

The second frame 50 extends over both the outer sole heel portion 12 through the outer sole forward portion 14. The second frame 50 includes an arch portion 13 that extends between the outer sole heel portion 12 and the outer sole forward portion 14. The second frame 50 includes a heel portion 51, an arch portion 52 and a forward portion 53. As used herein, a "flexor" is a frame extension forced to a lever function that flexes from the result of a change in the frame border sections which are programmed with weaker characteristics that share the path of the frame lever arm. Frame lever extensions that meet the border sections programmed limit, force the flex zone to react to the opposing borders that are programmed or designed with more compression limit, less compression limit or no compression limit. The weak zone borders altering between different flex limit zones change the extending frame sections direction and lever functions at angles that relay a continual structure change from pressure changes upon the compression limit zones that border these weaker sections. For example, the tuberosity at the base of the fifth metatarsal needs to be free of opposing force during the beginning of the stance phase, described below. Therefore, the foot moves forward to find a weak zone in the area proximal to the posterior base of this metatarsal, the posterior section of the weak zone is limited in compression while the anterior weak zone has no compression limit, therefore, the anterior weak zone frame suspends downward while maintaining stabilization from upward pressure from the posterior frame section.

As used herein a "director" is a weaker section of the frame material that allows the frame to torque or twist. As used herein a "fold zone" is a longitudinal weak section that stabilizes medial lever arm lateral borders and posterior weak flex zone from alternating lateral lever arm and posterior weak flex zone movement during the natural transverse transfer phase from anterior lateral downward pressure to medial toe pressure.

During the "transverse transfer phase", this fold zone moves the frame to an alternate position from the foot demands for shoe stabilization and control during the natural path in motion of the foot. Therefore, the mid-foot is allowed to maintain in shoe positioning while suspending the transverse arches in the non-obstructing frame suspension zones and mid-foot loft zone. While the metatarsal heads and extending toes alternate the pressure shift from lateral stance phase to medial toe off phase, the fold zone interacts with the foot which indicates the path change while transferring demands without shifting the mid-foot out of position. In general, the frame can shift its anterior lateral lever arm and tabs and anterior medial lever arms medial and lateral borders up and down at alternating angles, this is done without interfering with mid-foot stabilization. The movement between the lateral border of the medial lever arm and the medial border of the lateral lever arm is from the longitudinal weak fold zone.

The second frame heel portion 51 includes a plurality of openings corresponding to the locations of first frame protrusions 44. The second frame heel portion 51 also includes a first director 54 and a first frame flex stabilizer 55. The first frame flex stabilizer 55 is structured as a weak zone that extends approximately a half inch longitudinally and one inch inwardly. When the foot moves toward the weak zone, the zone suspends the anterior more rigid frame section downward, levering the anterior inner frame of the inner anterior arch upward, controlled through suspension from the stabilized posterior frame bordering section that is locked from a rigid gripping plantar protrusion. A second director 57 is located at the forward end of the second frame heel portion 51. Second and third frame directors 58, 59 are disposed at the forward end of the second frame arch portion 52.

The second frame forward portion 53 also includes two caps 60, 61 that extend generally downward and perpendicular to the body of the forward portion 53. A first metatarsal pocket 62 is disposed on the inner side of the second frame forward portion 53 adjacent to the second frame arch portion 52. A plurality of flex tabs 63 extend from the medial portion of second frame forward portion 53 to the forward end of second frame forward portion 53. On the inner side of the second frame forward portion 53, i.e. below the big toe, is a lever arm flex director 66.

The third frame assembly 70 extends, generally, over the outer sole forward portion 14. The third frame 70 includes a generally flat body 71 having protrusions 72 which extend downwardly. A plurality of voids 73 are provided between the protrusions.

The reactive upper sole assembly 30 also includes additional layers that couple and space the first frame assembly 40, the second frame assembly 50, and the third frame assembly 70. These layers include a first compression zone 80 and a second compression zone 90. The first and second compression zones 80, 90 are made from nylon, TPU, TPR, EVA, or rubber. The compression zones 80, 90 may be rigid or flexible, have various resiliences and thicknesses. The compression zones 80, 90 have openings therethrough that allow any protrusions 44 to pass. Additionally, there are first and second suspension zones 100, 110 made from nylon, TPU, TPR, EVA or rubber.

The layers of the reactive upper sole assembly 30 and the outer sole assembly 10 are coupled as follows. At the rear end of the sole that will be below the heel of the user, the first frame assembly 40 is disposed closest to the user. Below the first frame assembly 40 is the first compression zone 80. Below the first compression zone 80 is the second frame heel portion 51. Additionally, at the forward end of the first frame assembly 40, the first suspension zone 100 is disposed between the first frame assembly 40 and the second frame assembly arch portion 52. Below the second frame heel portion is the outer sole heel portion 12. The outer sole heel portion protrusions 16, located below the first frame protrusions 44, are hollow. Thus, the first frame protrusions 44 may be moved into or out of the outer sole heel portion protrusions 16.

At the forward end of the sole assembly 1, the second frame forward portion 53 is disposed adjacent to the wears foot. Below the second frame forward portion 53 is the second compression zone 90. Below the second compression zone 90 is the third frame assembly 70. The third frame assembly 70 also extends rearwardly below the second frame arch portion 52. The second suspension zone 110 is disposed between the second frame arch portion 52 and the third frame assembly 70. Below the third frame assembly 70 is the outer sole forward portion 14. The outer sole heel portion protrusions 16, located below the third frame protrusions 72, are hollow. Thus, the third frame protrusions 72 may be moved into or out of the outer sole heel portion protrusions 16.

A human step, or gait, can be divided into three phases and transitions between those phases. Three phases are heel strike, stance, and toe-off. During use, the sole assembly acts as in the following manner. During the heel strike phase, the first frame assembly protrusions 44 move downward to the compression limit proximal to the rear boarder of the heel portion director 54. This action lock levers on the second frame assembly heel portion 51 upward. The upward movement braces the second frame director 58 located on second frame arch portion 52 and suspends the first metatarsal head pocket 62 while supporting the toe off lever 66.

Upon transitioning to the stance phase, the second frame assembly second director 57 is pushed downward from the stance phase lateral compression of first and second suspension zone 100, 110, as the foot moves to the stance phase. This compression forms a suspension zone for the base of the fifth metatarsal head and the brevis tendon. The lateral compression continues medial stabilization of the second frame assembly 50 and corresponding second frame director 58 to toe off lever 66 while suspending the first metatarsal in the pocket of 62.

Moving from the stance phase to the toe-off phase, the first suspension zone 56 levels and regulates transverse compression of second frame assembly 50. Lateral compression between the second frame assembly 50 and third frame assembly 70 is regulated by lateral compression of the second suspension zone 110. Additionally second frame outer cap 60 compresses the second low compression zone 90 to stabilize the outer side of the sole. Throughout the stance phase compression, third frame protrusions 72 move into outer sole forward portion protrusions 16. This action locks and moves the outer sole protrusions for traction, grip and direction.

When transitioning to the toe off phase, the third director 59 flex zone moves the forward portion of second frame forward portion 53 proximal to upward as the rearward area proximal to the third director moves downward. This engages downward pressure of flex tabs 63 directing transverse stabilization of the toe off lever 66. The transfer of pressure moves inwardly, guided and controlled along the suspended transverse plane of the second suspension zone 110. The transverse medial transfer moves to gradually compress the second frame director 58 controlled by second suspension zone 110 and third frame assembly 70 resistance. This medial compression creates a posterior medial arch suspension zone regulated from internal pressure of the medial section of the first suspension zone 100. That is, the frame wraps the inside of the front half of the inside arch, while the side wrap tapers off to not wrap the rear portion of the medial arch. This creates a suspension zone due to the wear's foot compressing the upper body material in the back arch area with a stabilized front arch wrapped on the side by the rigid frame material regulated from internal pressure of the medial section of the first suspension zone 100.

Proceeding to the toe off phase, the first metatarsal head rolls forward along the suspension pocket of 62. The roll zone is regulated by compression between the inner second frame cap 61 and medial section of third frame assembly 70. The compression of the anterior medial arch releases as the foot moves forward compressing the toe off lever 66. The toe off lever 66 is stabilized by a fold zone created from the inward and downward compression of the tabs 63. The tabs 63 are regulated by and move corresponding tabs (not shown) of the plantar section of the third frame assembly 70. These tabs move downward, creating a longitudinal fold zone between the most medial tabs 63 and the toe off lever 66.

At the final toe off phase, the compression of toe off lever 66 moves the third frame assembly protrusions 72 downward into the voids of the outer sole protrusion 16. The voids are positioned to the posterior section of the external protrusion interior. The third frame assembly protrusions 72 fill the voids to lock, angle and position the external protrusions for traction and gripping, while maintaining direction through toe off.

Another embodiment of the reactive upper sole, according to the present invention, is shown in FIGS. 2–15 and will now be described. According to this embodiment, the reactive upper sole includes a foot bed 200 that is structured to be placed on top of a first frame assembly 40 and the second frame assembly forward portion 53. The foot bed 200 is an insert that is structured to cooperate with the e.g., and mid sole and an outer sole (not shown). The characteristics features of the foot bed 200 may be changed by changing the materials used for manufacture of the foot bed 200 and altering the number and/or location of the various components. For example, a wearer, such as an athlete, may need only one outer sole, but may have a plurality of foot beds 200 each structured to act or function differently. That is, one foot bed 200 may be structured for running on pavement, another for running on cross country trials, and a third foot bed 200 may be structured for climbing rocks.

The foot bed 200 includes a plurality of folding directional levers 201, 202, 203. The first lever 201 extends longitudinally on the outer side of the forward portion of the sole. The second lever 202 extends longitudinally on the inner side of the forward portion. The third lever 203 extends, generally, perpendicular to a longitudinal axis of the foot bed 200 at the arch portion 213. An upper body 210 links the folding directional levers 201, 202, 203 that help the foot control the shoe throughout the toe off phase. The fore foot engages a first anterior lateral lever 201 that alters in angle to move the medial lever tabs 204, 205, 206 at downward angles along front and rear weak zones forming a longitudinal medial fold zone 207 located approximately between the big toe and the second toe and extending longitudinally to the ball of the foot. This movement structures the medial second lever 202 that extends longitudinally bordered by the guiding support of the fold zone. Posterior to the medial second lever 202, an anterior medial arch wrap lever 203 levered by the plantar protrusions that alter in depth allowing the first metatarsal to move and angle the anterior metatarsal head along the suspension zone 221 (described below). This allows the posterior metatarsal and anterior toe to an uninterrupted off phase positioning. The downward lever action of the anterior medial arch moves and stabilizes the medial second lever 202 upward as it supports the front of the medial arch in motion to the toe off phase. These folding directional levers 201, 202, 203 may extend the full length of the foot bed 200. These levers 201, 202, 203 cooperate with the directors in the second frame assembly 50. Thus, the user's foot activates levers in the foot bed 200 which act on the directors in the second frame assembly 50 which, in turn, act on the outer sole 10.

The foot bed 200 typically includes three layers, an upper body 210, a foot bed frame assembly 230, and a foot bed composite 250. In some applications, the foot bed 200 may includes a fourth layer, namely, a canting assembly 260 attached to protrusions of the foot bed frame assembly 230. It is to be appreciated that there may be less layers or the various layers may be combined with one anther to form an integral and unitary structure. The upper body 210 is generally shaped as an insole having a plurality of regions. The regions are made from different materials, or different compositions of a single material, so that each region has a specific resiliency. The upper body 210 has an upper surface 211 and a bottom surface. Some regions of the body may overlie other regions of the other components of the foot bed 200 as described below in further detail.

Figure 3:
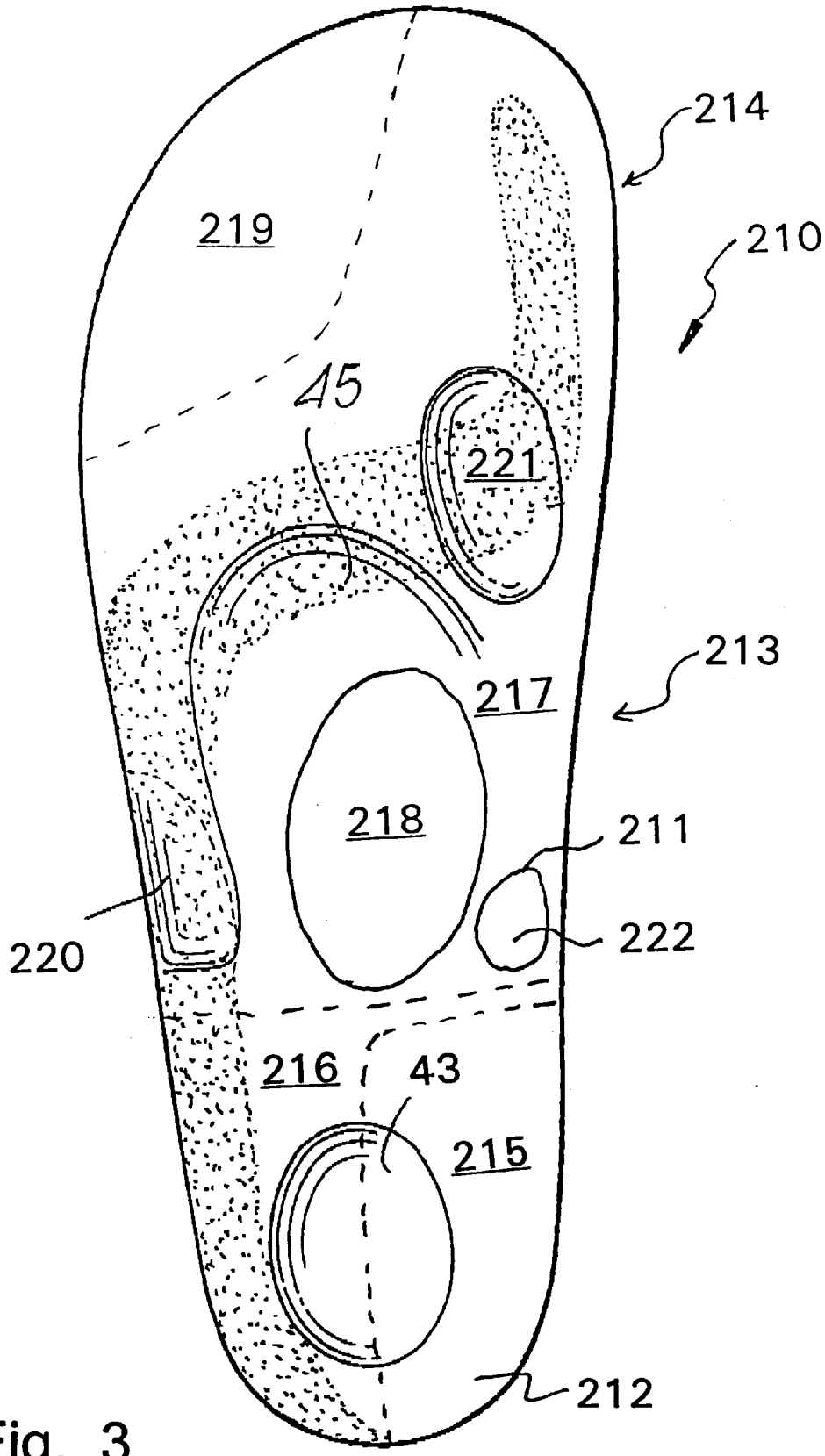
FIG. 3 is diagrammatic top plan view of FIG. 2.
Figure 4:
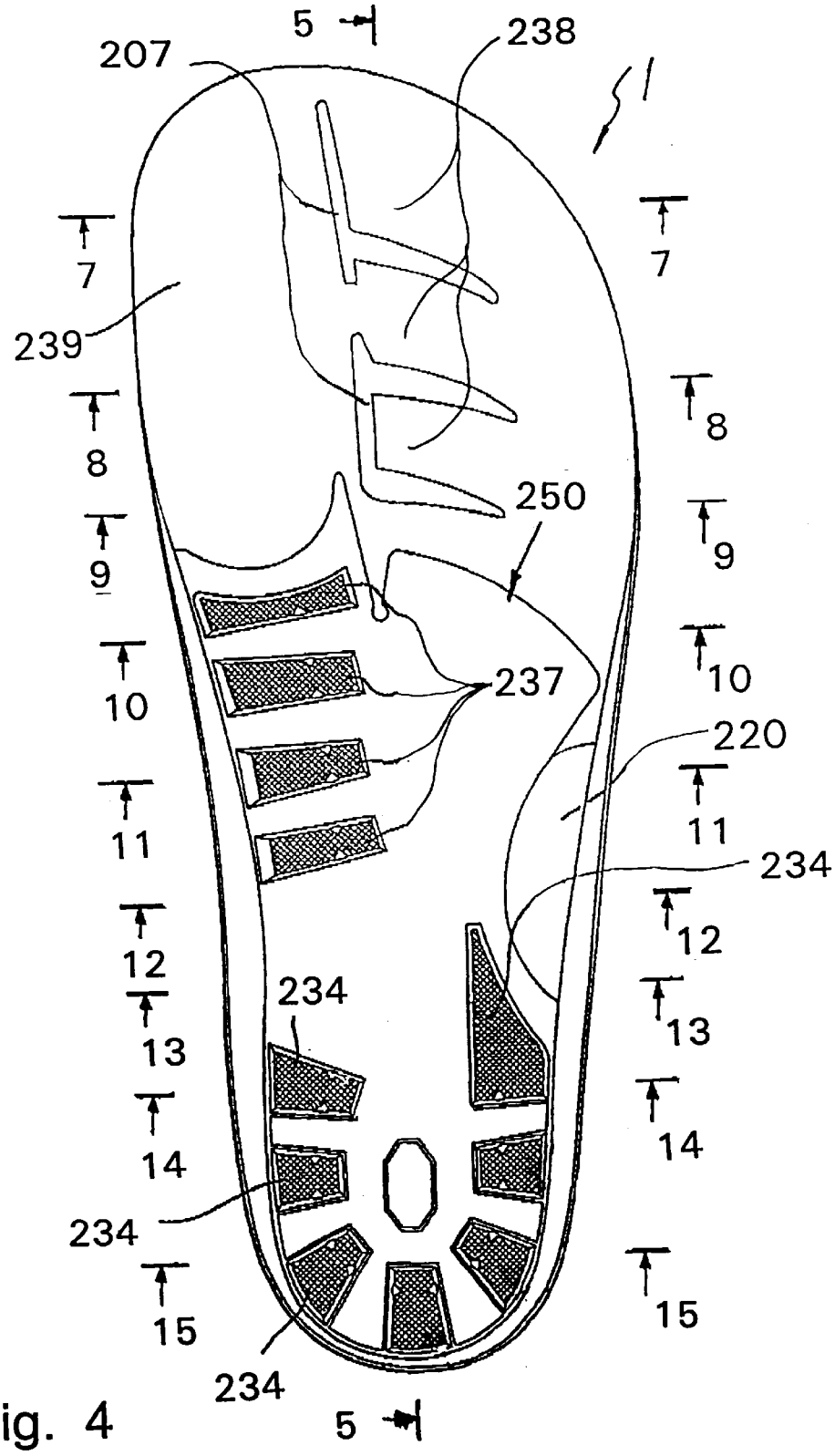
FIG. 4 is diagrammatic bottom plan view of FIG. 2.
Figure 5:
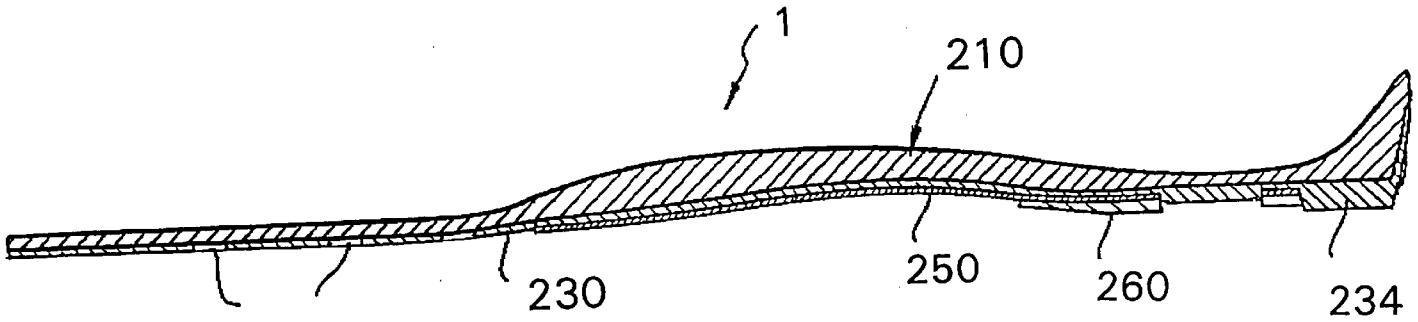
FIG. 5 is diagrammatic cross-sectional view along section line 5—5 of FIG. 2.

The upper body 210 includes a heel portion 212, an arch portion 213, and a forward portion 214 (FIG. 3). The foot bed 200 has an inner side and an outer side corresponding to the inner and outer sides of a human foot. The elongate side of the sole 1 that is structured to contact a user's big toe is referred to as the "inner" side of the sole 1, and the elongate side of the sole that is structured to contact the user's little toe is referred to as the "outer" side. A first region 215, located at the inner side of the foot bed heel portion 212, is manufactured from a firm material, such as nylon, TPU, or TPR. A second region 216, located at the outer side of foot bed heel portion 212, manufactured from a less firm composition such as EVA. A third region 217, extending from the heel portion 212 over the arch portion 213 and along the inner side of the forward portion 214, is manufactured from a firm material such as nylon, TPU, or TPR. A fourth region 218, surrounded by the third region 217 is manufactured from a soft material, such as EVA or urethane, and is structured to support the arch of the wear's foot during use. A fifth region 219, located on the outer side of foot bed forward portion 214, is manufactured from a firmer material such as EVA or urethane.

A first foot bed suspension zone 220 is provided on the outer side of the foot bed arch portion 213. The first foot bed suspension zone 220 is provided in the third region 217. A second foot bed suspension zone 221 is located on the inner side between the foot bed arch portion 213 and the foot bed forward portion 214. A third foot bed suspension zone 222 is located on the inner side between the foot bed heel portion 212 and the foot bed arch portion 213. The three suspension zones tend to be softer areas than the remainder of the foot bed 200.

Figure 2:
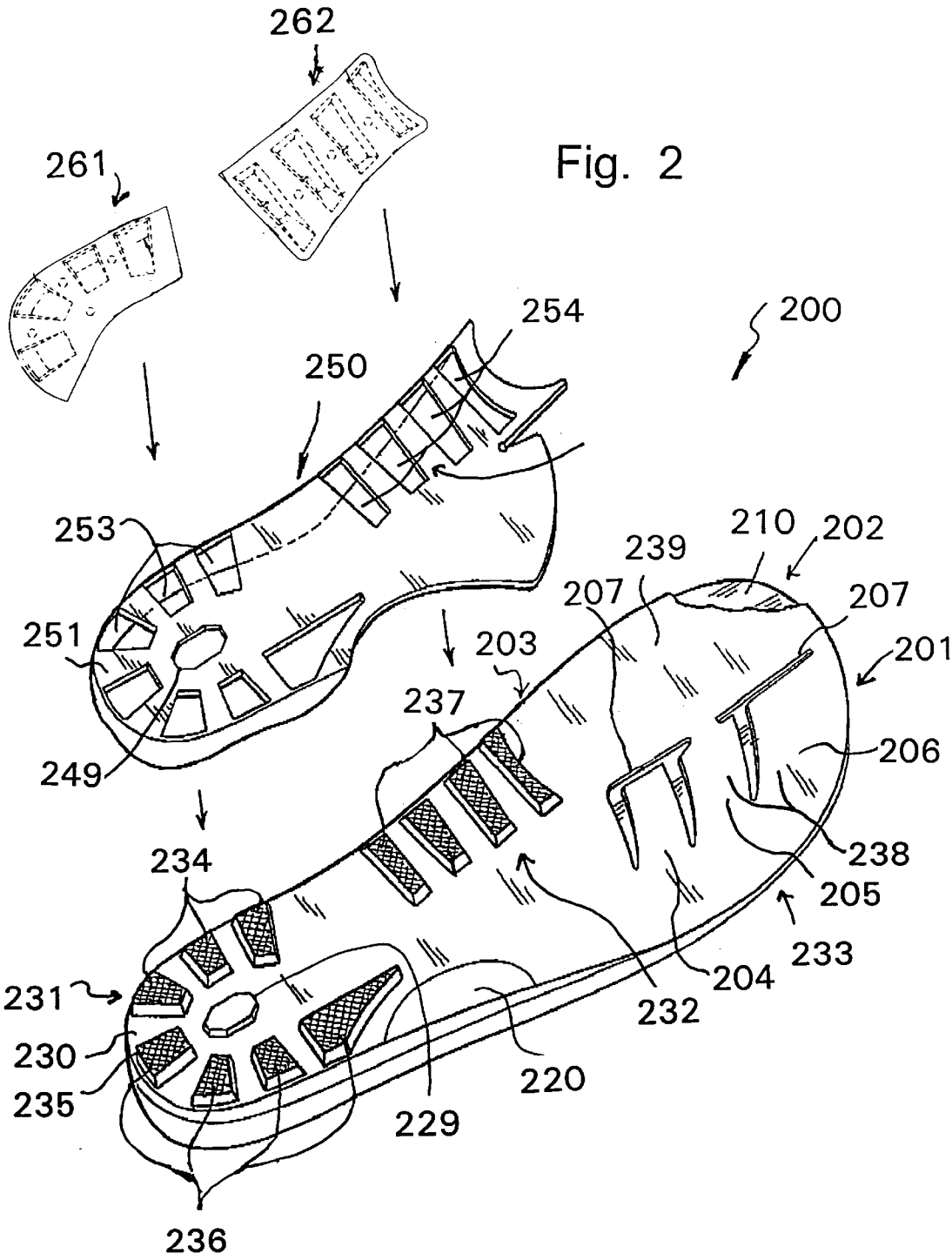
FIG. 2 is a diagrammatic exploded perspective view of a second embodiment showing the various components for the sole assembly according to the present invention.

The foot bed frame assembly 230 typically includes a heel portion 231, an arch portion 232, and a forward portion 233 (FIG. 2). The foot bed frame assembly 230 is manufactured from a rigid material such as nylon, TPU, or TPR. The foot bed frame assembly heel portion 231 includes a plurality of heel protrusions 234, e.g., seven heel protrusions, which extend around and radially about the periphery of the foot bed heel portion 231. The plurality of foot bed heel protrusions 234 each have a flat radially outer area 235 and may have an inclined radially inner area (not shown) which is inclined toward or tapers toward a base of the foot bed frame assembly 230. The inclined radially inner area, if present, generally is angled toward and directed at a center of the foot bed frame assembly heel portion 231. The first plurality of foot bed protrusions 234 do not overly either the first or third foot bed suspension zones 220, 222. An opening may be formed in a central region of foot bed frame assembly heel portion 231. All of the heel protrusions 234 can have identical physical properties or characteristics. Alternatively, the heel protrusions 234 located on the inner side of the sole can be manufactured from a harder material while the heel protrusions 234 located on the outer side of the sole can be manufactured from a softer more resilient material. The softer more resilient material will assist the foot in follow its normal walking path and avoid early pronation of the foot.

Figure 6:
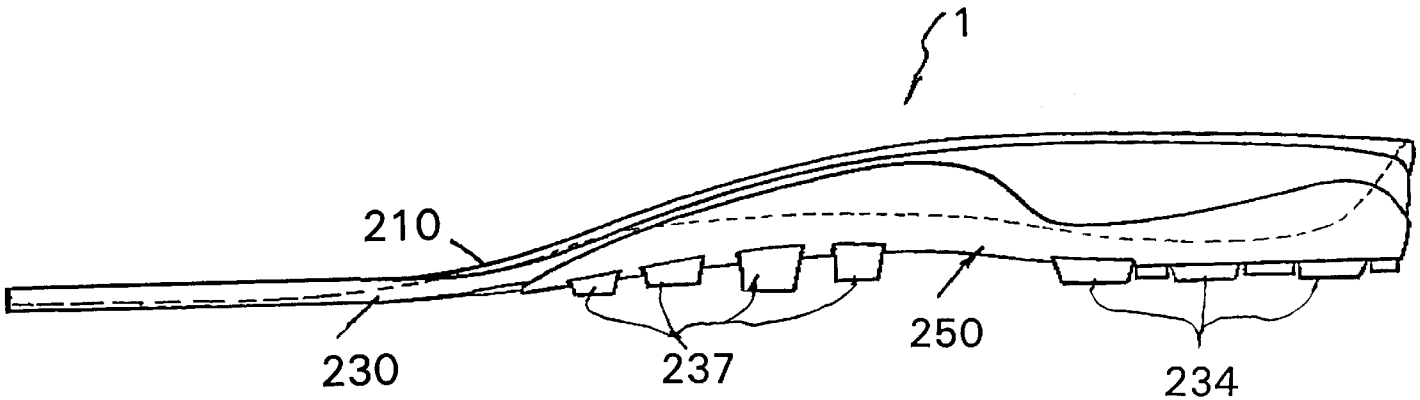
FIG. 6 is diagrammatic inner side elevational view of FIG. 2.

A plurality of foot bed arch protrusion 237, e.g., four sequentially arranged arch protrusions, are located on the inner side of the foot bed arch portion. Each arch protrusions 237 is an elongated protrusion having a longitudinal axis extending generally perpendicular to the inner side of the foot bed frame assembly arch portion 232. The forward edge of each arch protrusions 237 is angled forward, away from the heel portion, toward the forward portion 214 of the sole. All of the heel and arch protrusions 234, 237 project downwardly away from a base of the foot bed frame assembly 230 (FIG. 6). The outer side of the forward portion 233 of the foot bed frame assembly 230 includes a plurality of foot bed tabs 238 while the inner side thereof includes a diving board or toe off lever 239. All of the arch protrusions 237 can have identical physical properties or characteristics. Alternatively, one or both of the arch protrusions 237 located toward the forward portion 214 of the sole can be manufactured from a softer more resilient material while the remaining arch protrusions 237 located adjacent the heel portion 212 of the sole can be manufactured from a firmer material. The softer more resilient material will assist with a gentle lowering of the arch.

Figure 6A:
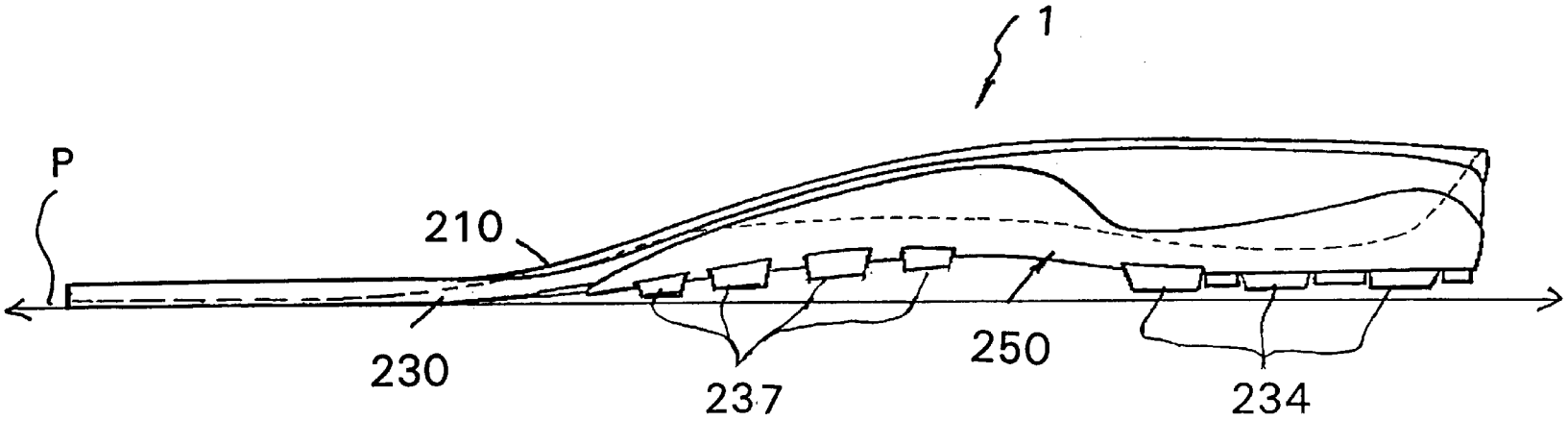
FIG. 6A is diagrammatic inner side elevational view of the inner sole showing another variant of the arch protrusions.

A slight variation of the arch protrusions is shown in FIG. 6A. As can be seen in this Figure, the sole difference between this embodiment and that of FIG. 6 is the height of the arch protrusions 237 is altered. That is, in this embodiment the arch protrusion 237 located closest to the forward portion of the sole extends downward and has a bottom surface which is coincident with a plane P defined by a base of the foot bed 200. The arch protrusion 237 next closest to the forward portion 214 of the sole extends downward toward but has a bottom surface which does not completely extend to be coincident with the plane P defined by the base of the foot bed 200. The arch protrusion 237 third closest to the forward portion 214 of the sole extends downward toward but also has a bottom surface which does not extend to or is coincident with the plane P defined by the base of the foot bed 200. Lastly, the arch protrusion 237 closest to the heel portion 212 extends downward toward but has a bottom surface which is spaced furthest away from the plane P defined by the base of the foot bed 200. In all other respects, this embodiment is substantially identical to that of FIG. 6.

Figure 6B:
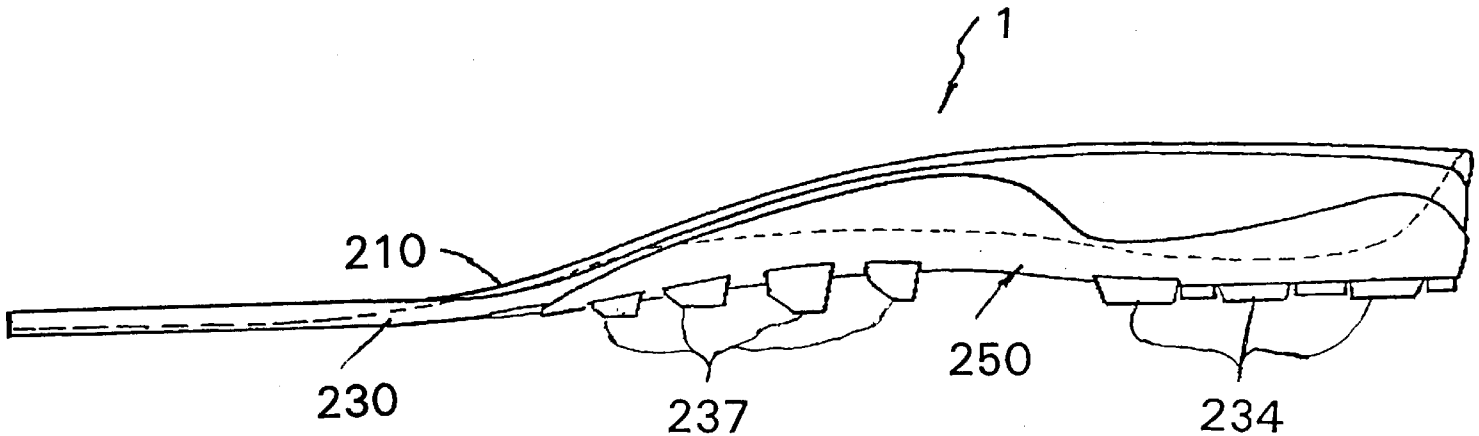
FIG. 6B is diagrammatic inner side elevational view of the innersole showing a third variant of the arch protrusions.
Figure 7:
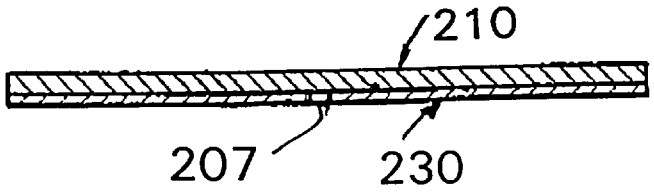
FIG. 7 is diagrammatic cross-sectional view along section line 7—7 of FIG. 2.
Figure 8:
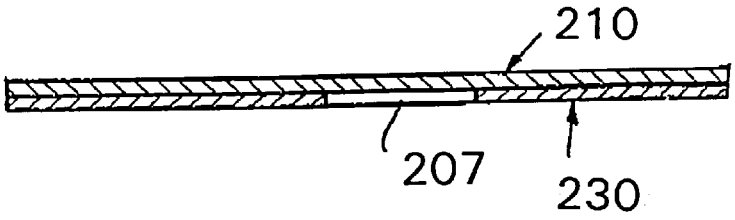
FIG. 8 is diagrammatic cross-sectional view along section line 8—8 of FIG. 2.
Figure 9:
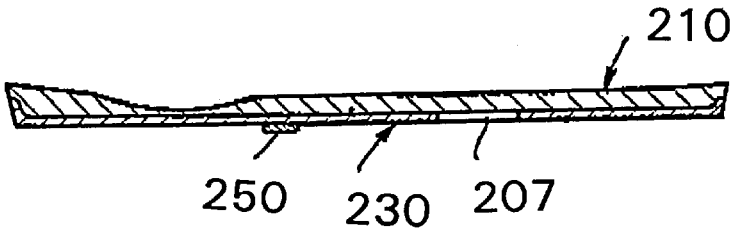
FIG. 9 is diagrammatic cross-sectional view along section line 9—9 of FIG. 2.
Figure 10:
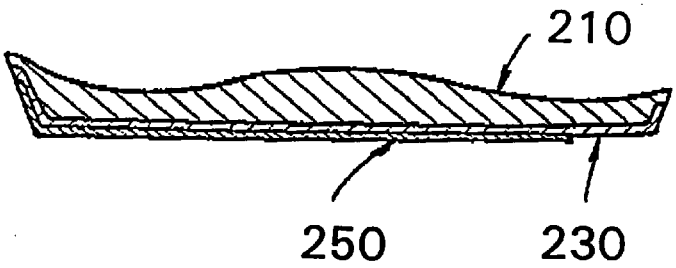
FIG. 10 is diagrammatic cross-sectional view along section line 10—10 of FIG. 2.
Figure 11:
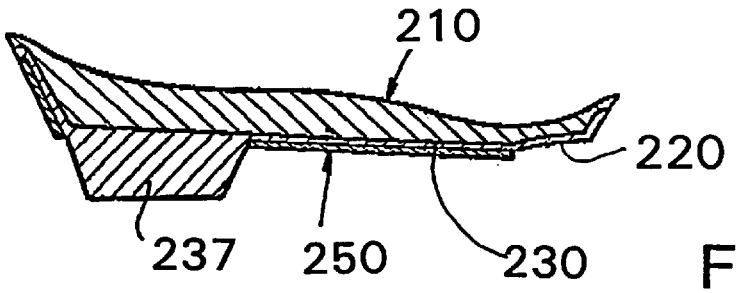
FIG. 11 is diagrammatic cross-sectional view along section line 11—11 of FIG. 2.

A further variation of the arch protrusions is shown in FIG. 6B. As can be seen in this Figure, the shape of the arch protrusions 237 is slightly varied from that of FIG. 6. The sole difference between this embodiment and that of FIG. 6 is that the entire length of the forward most, downwardly facing edge of each one of the arch protrusions 237 is beveled or chamfered. In all other respects, this embodiment is substantially identical to that of FIG. 6.

The foot bed composite 250 (FIG. 2) is generally a rigid assembly manufactured from nylon, TPU, or a composite fiber, for example. The foot bed composite 250 has a heel portion 251 and an arch portion 252. The composite heel portion 251 includes a plurality of heel openings 253 corresponding in size, shape and location to receive the heel protrusions 234. The composite arch portion 252 includes a plurality of arch openings 254 corresponding in size, shape and location to receive the plurality of arch protrusions 237. It is to be appreciated that the foot bed composite 250 does not obstruct any of the suspension zones 220, 221, 222. The foot bed composite 230 also has a medial opening 249 in the heel portion 251. The foot bed composite 250 is cambered upward to support the arch of the user.

If the foot bed 200 includes a fourth layer, this layer generally comprises a canting assembly 260 which includes two clips 261, 262. The clips 261, 262 are structured to change a heel lift plane. One clip is structured to attach to a group of the plurality of heel protrusions 234, e.g., four of the heel protrusions located along the inner side of the sole, while the second clip 262 is structured to attach to all of the arch protrusions 237. Each one of the two clips 260, 262 has a plurality of mating cavities formed therein with each one of the mating cavities sized, shaped and located to receive one of the respective heel or arch protrusions 234, 237. The two clips 260, 262, once attached, combine with one another to form a plane that tapers or a two piece plane that forms one even plane. The clips 261, 262 increase the spacing of the upper surface of the body heel portion 212, along the inner side, relative to a remainder of the shoe sole. That is, the foot bed 200 is generally flat at the second suspension zone 221 and thicker at the inner side of the heel. Preferably, the taper between the heel and the second suspension zone 221 for the first metatarsal head is between about 2 to 4 degrees.

The foot bed 200 is assembled as follows. The upper body 210 forms the uppermost top layer which is located to contact and engage with the wear's foot. The next top most layer is the foot bed frame assembly 230. The foot bed composite 250 is attached to the foot bed frame assembly 230 with the plurality of heel protrusions 234 extending through the plurality of heel openings 253 and the plurality of arch protrusions 237 extending through the plurality of arch openings 254. If desired or necessary, the canting assembly 260, 262 are attached to the plurality of heel and arch protrusions 234, 237. The main object is the canting assembly 260 is to change the plane of the foot bed, starting with a lift of the heel that has a gradual angle that tapers longitudinally downward toward the front outer side of the sole such that there is virtually no lift behind the first metatarsal.

With reference to the conventional three phases of a step, with a transition between each of the three phases, the foot bed 200 operates as follows. The heel strikes first while the plurality of heel protrusions 234 flex to stabilize against posterior foot bed frame assembly arch portion 232 distortion, the heel shape centers between body first region 215 and second region 216 of the heel portion 212. The firm first region 215 stabilizes against early pronation while the soft second region 216 flexes forming a heel roll zone.

As the foot moves toward the stance phase, the plurality of heel protrusions 234 slope downward to a void in the posterior of the foot bed frame assembly arch portion 232. The tuberosity of the base of the fifth metatarsal head suspends into a semi firm body third region 217 supporting a pocket of the first foot bed suspension zone 220. The suspension is maintained by the posterior void by plurality of heel protrusions 234 and the anterior void of the foot bed frame assembly arch portion 232 camber. Camber is created in the foot bed frame assembly arch portion 232 from the void between the height and angle of the most lateral section of the plurality of heel protrusions 234 and the most lateral anterior level transverse plane of the foot bed frame assembly arch portion 232. As the lateral foot suspends into the first foot bed suspension zone 220, the head of the first metatarsal suspends into a medial pocket of the second foot bed suspension zone 221. The first metatarsal head is suspended because the plurality of heel protrusions 234 are angled forward with an alteration in depth between the protrusions. As pressure is placed upon the plurality of heel protrusions 234, the plurality of heel protrusions 234 move downward and forward with a spring effect forming the second foot bed suspension zone 221. During the stance phase, the medial and lateral suspension zones position the frame for least resistance to multiple foot shapes, and the mid-foot is cradled as it falls on a large convex soft fourth region 218.

As the foot moves towards the toe off phase, the most anterior lateral protrusion of the plurality of heel protrusions 234 maintain lateral suspension in first foot bed suspension zone 220 while the camber in the anterior lateral section of the foot bed frame assembly arch portion 232 flexes downward. The downward pressure moves to transfer medially as the fifth region 219 and medial frame toe off lever 239 resists compression, the medial transfer moves center tabs of the medial mid section of anterior frame section, including the foot bed tabs 238, downward. This stabilizes a fold zone 207 between the anterior lateral frame section levers and the medial toe of lever of the medial frame toe off lever 239. The materials of the anterior frame sections are semi rigid, rigid type materials of TPU, nylon type.

During the toe off phase, the medial portion of the plurality of heel protrusions 234 flex downward and angle forward, this supports the anterior section of the medial arch, while suspending the lateral section of the medial arch along a frame void adjacent to third foot bed suspension zone 222. The third foot bed suspension zone 222 allows the lateral arch to adjust the flexion of the soft body of second region 216 and semi firm body third region 217. The lateral arch suspension zone allows the foot to engage the toe off sequence without resistance to the natural path to the foot from the frames. At toe off, the first metatarsal head rolls forward on the second foot bed suspension zone 221, the zone is suspended between the engaged plurality of heel protrusions 234 and the anterior toe off lever 239. The first metatarsal head flexes the base of the fold zone toe off lever 239 to release all posterior frame compression for a stabilized and controlled toe off.

With reference to FIGS. 16–30, a third embodiment of the reactive upper sole, according to the present invention will now be described. According to this embodiment, the reactive upper sole includes a foot bed 300 that is structured to be placed on top of a first frame assembly 40 and the second frame assembly forward portion 53. The foot bed 300 is an insert that is structured to cooperate with the e.g., and mid sole and an outer sole (not shown). The characteristics features of the foot bed 300 may be changed by changing the materials used for manufacture of the foot bed 300 and altering the number and/or location of the various components.

The foot bed 300 includes a plurality of folding directional levers 301, 302, 303. The first lever 301 extends longitudinally on the outer side of the forward portion of the sole. The second lever 302 extends longitudinally on the inner side of the forward portion. The third lever 303 extends, generally, perpendicular to a longitudinal axis of the foot bed 200 at the arch portion 313. An upper body 310 links the folding directional levers 301, 302, 303 that help the foot control the shoe throughout the toe off phase. The fore foot engages a first anterior lateral directional lever 301 that alters in angle to move the medial lever tabs 304, 305, 306 at downward angles along front and rear weak zones forming a longitudinal medial fold zone 307 located approximately between the big toe and the second toe and extending longitudinally to the ball of the foot. This movement structures a medial directional lever 302 that extends longitudinally bordered by the guiding support of the fold zone. Posterior to the medial directional lever 302, and the anterior medial arch wrap directional lever 303 are levered by the plantar protrusions that alter in depth allowing the first metatarsal to move and angle the anterior metatarsal head along the second suspension 321 (described below). This allows the posterior metatarsal and anterior toe to an uninterrupted off phase positioning. The downward lever action of the anterior medial arch moves and stabilizes the medial directional lever 302 upward as it supports the front of the medial arch during motion to the toe off phase. These folding directional levers 301, 302, 303 may extend the full length of the foot bed 300 and cooperate with the directors in the second frame assembly 50. Thus, the user's foot activates levers in the foot bed 300 which act on the directors in the second frame assembly 50 which, in turn, act on the outer sole 10.

The foot bed 300, according to this embodiment, includes only two layers, a combined upper body and frame assembly 310 and a foot bed composite 350. In some applications, the foot bed 300 may includes a third layer, namely, a canting assembly attached to protrusions of the combined upper body frame assembly 310. The body 310 is generally shaped as an insole having a plurality of regions. The regions are made from different materials, or different compositions of a single material, so that each region has a specific resiliency. The body 310 has an upper surface 311 and a bottom surface. Some regions of the body may overlie other regions of the other components of the foot bed 300 as described below in further detail.

Figure 17:
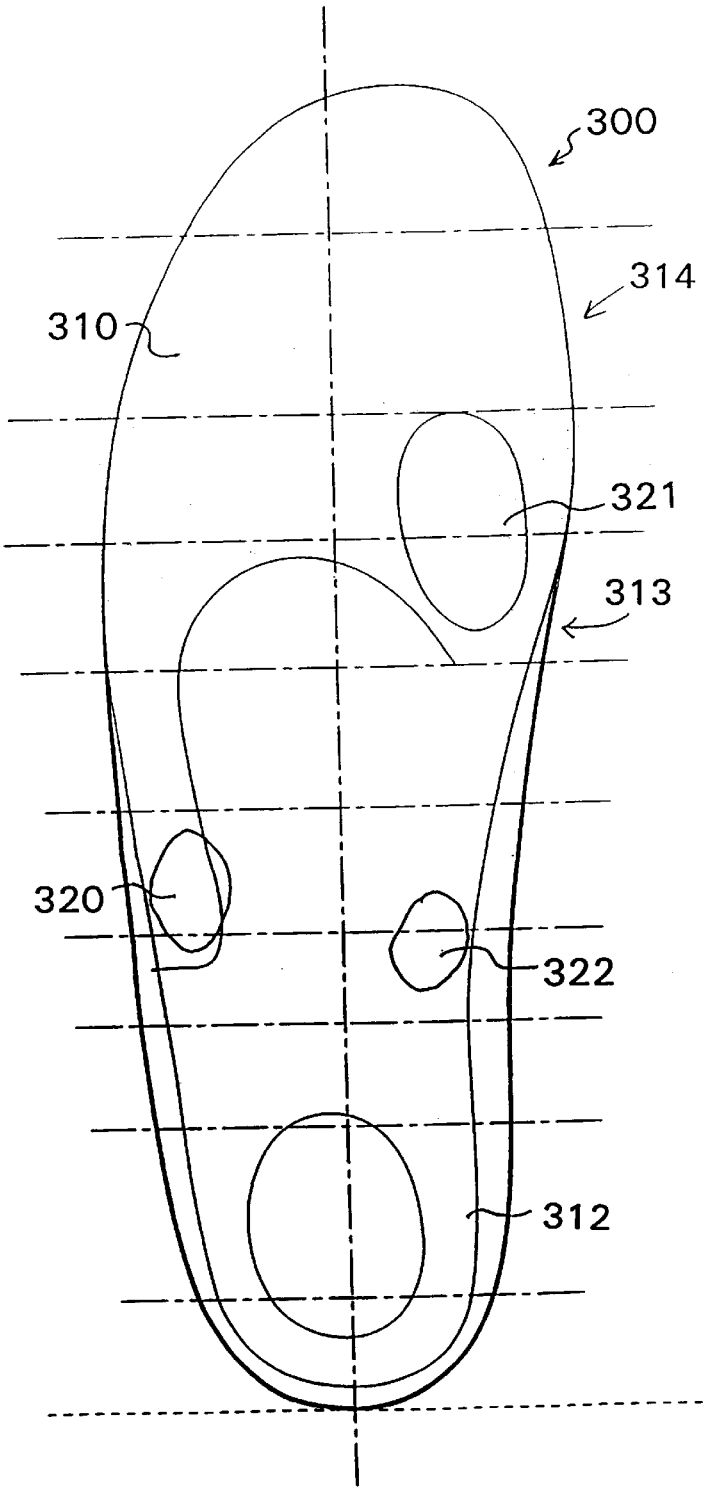
FIG. 17 is diagrammatic top plan view of FIG. 16.

The body 310 includes a heel portion 312, an arch portion 313, and a forward portion 314 (FIG. 17). The foot bed 300 has an inner side and an outer side corresponding to the inner and outer sides of a human foot. A first region 215, located at the inner side of the foot bed heel portion 312 (see FIG. 21), is manufactured from a firm material, having an EVA hardness of 45 C, for example. A second region 216, located at the outer side of foot bed heel portion 212, is manufactured from a less firm composition having an EVA hardness of 35 C, for example. A third region 217, extending from the heel portion 212 over the arch portion 213 and along the inner side of the forward portion 214, is manufactured from nylon, TPU, or TPR having a hardness of about 45 C, for example. A fourth region 218, surrounded by the third region 217 is manufactured from a soft material, such as EVA or urethane, having a hardness of 35 C, for example, and is structured to support the arch of the wear's foot during use. A fifth region 219, located on the outer side of foot bed forward portion 214, is manufactured from EVA or urethane having a hardness of 55 C, for example.

A first foot bed suspension zone 320 is provided on the outer side of the foot bed arch portion 313. The first foot bed suspension zone 320 is provided in the third region 217. A second foot bed suspension zone 321 is located on the inner side between the foot bed arch portion 313 and the foot bed forward portion 314. A third foot bed suspension zone 322 is located on the inner side between the foot bed heel portion 212 and the foot bed arch portion 213. The three suspension zones tend to be softer areas than the remainder of the foot bed 300.

Figure 16:
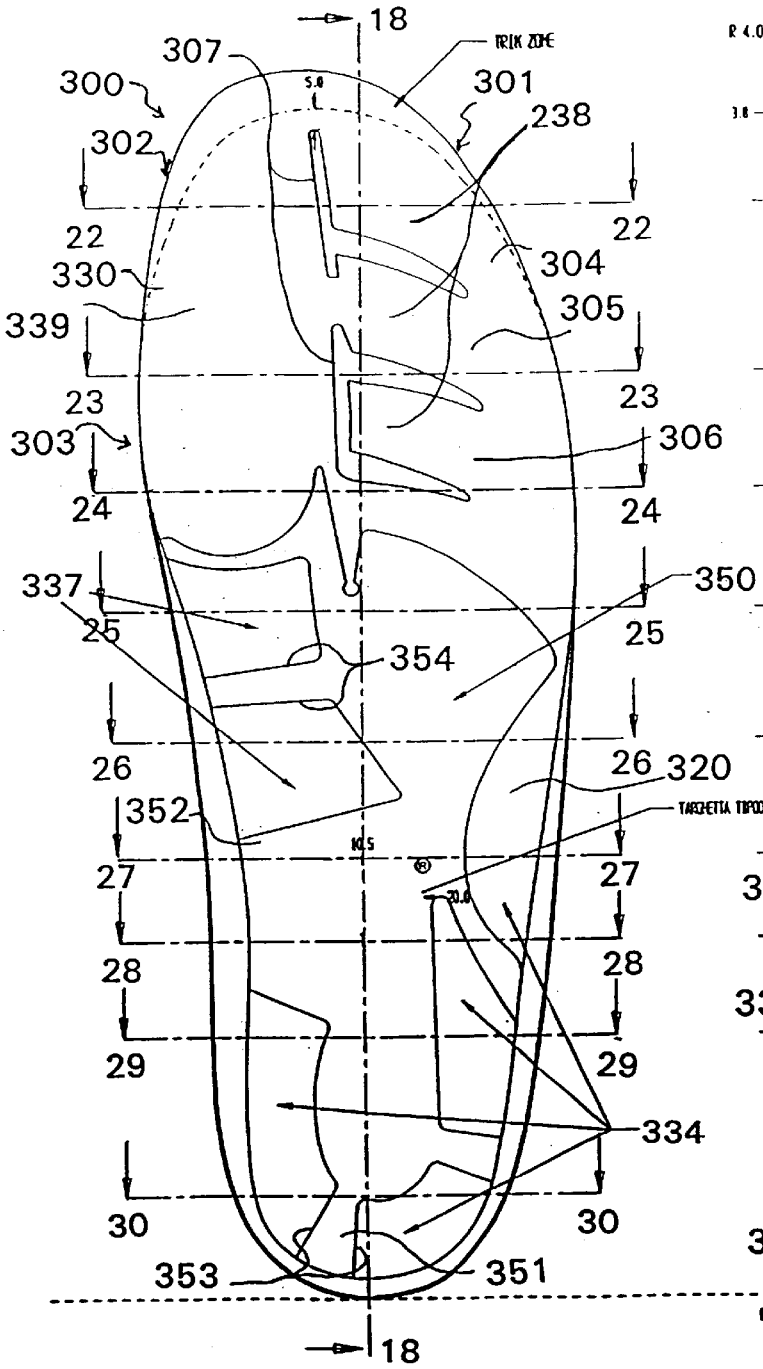
FIG. 16 is diagrammatic bottom plan view of a third embodiment of the various components for the sole assembly according to the present invention.
Figure 20:
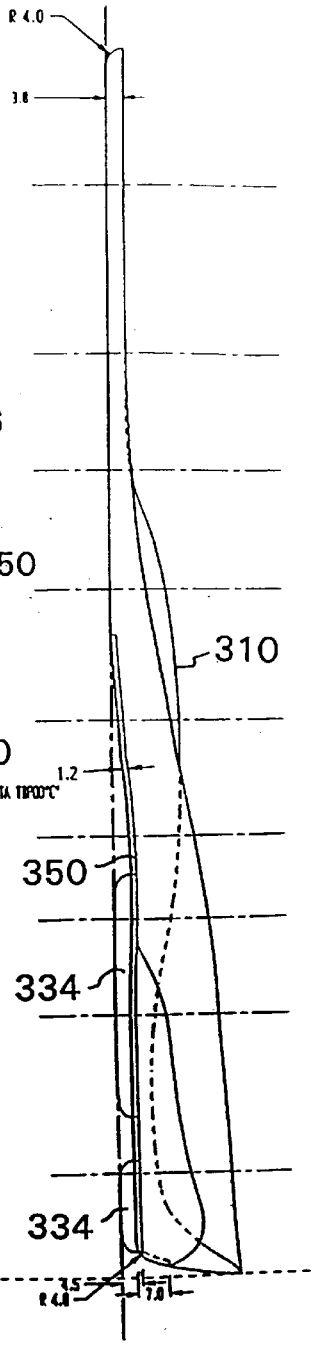
FIG. 20 is diagrammatic outer side elevational view of FIG. 16.
Figure 19:
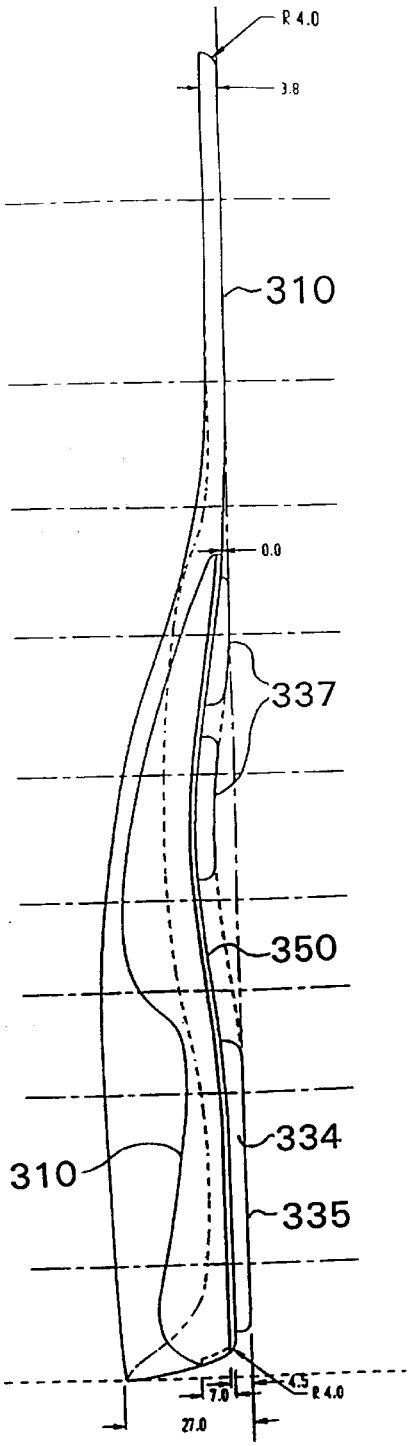
FIG. 19 is diagrammatic inner side elevational view of FIG. 16.
Figure 18:
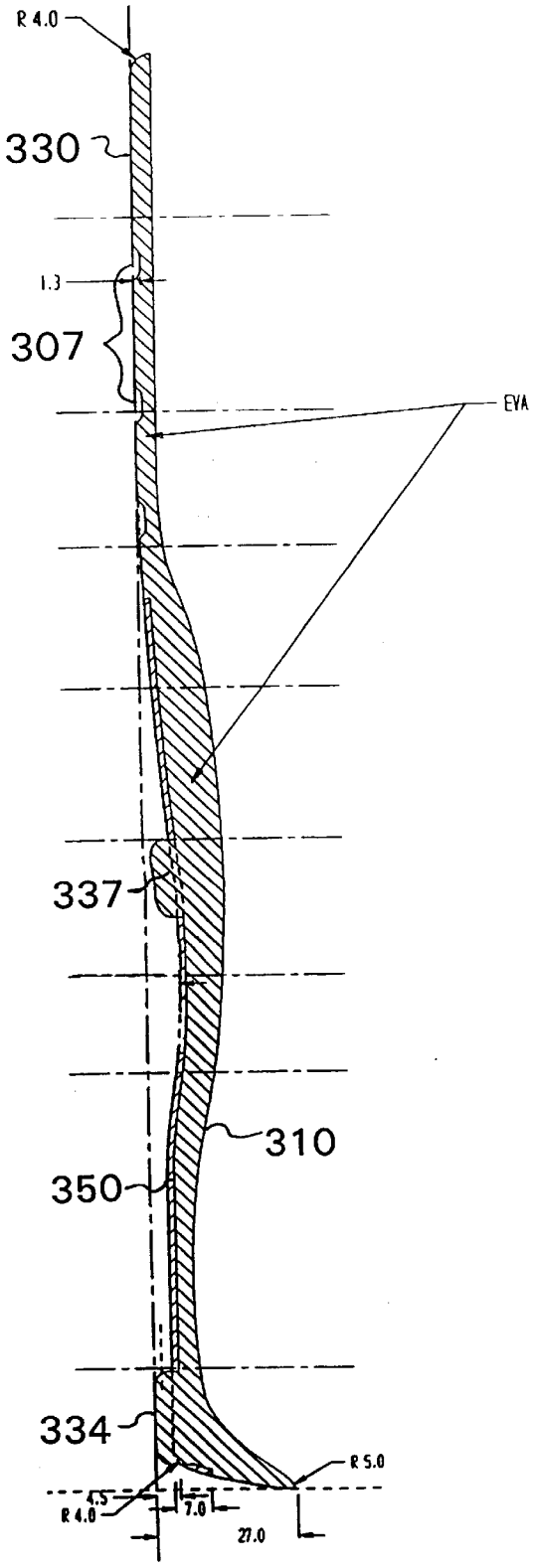
FIG. 18 is diagrammatic cross-sectional view along section line 18—18 of FIG. 16.
Figure 21:
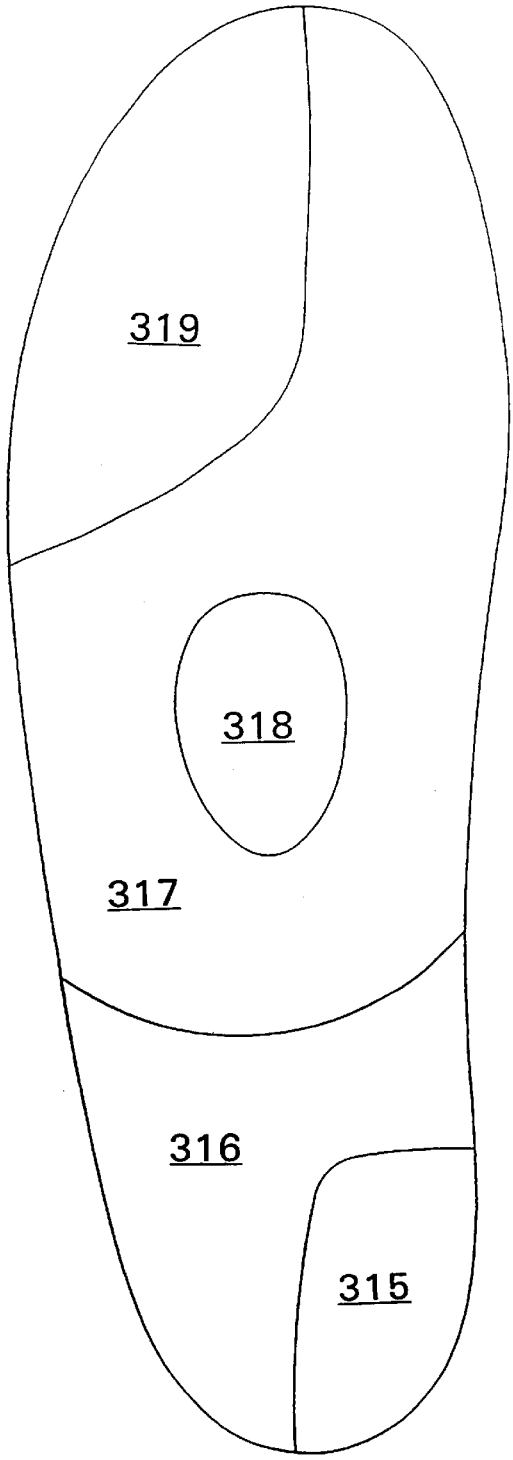
FIG. 21 is diagrammatic cross-sectional top plan view of FIG. 16 showing the various regions of the inner sole.
Figure 22:
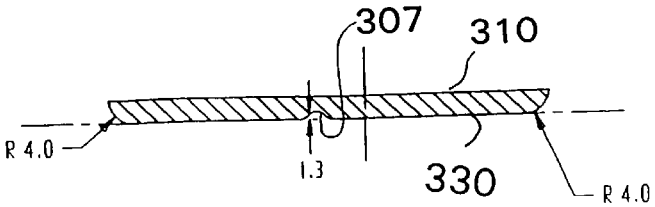
FIG. 22 is diagrammatic cross-sectional view along section line 22—22 of FIG. 16.
Figure 23:
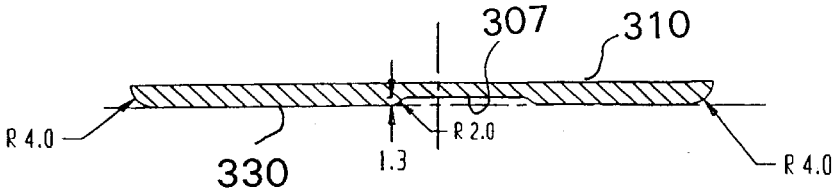
FIG. 23 is diagrammatic cross-sectional view along section line 23—23 of FIG. 16.
Figure 24:
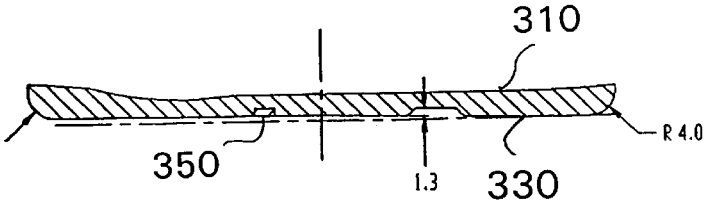
FIG. 24 is diagrammatic cross-sectional view along section line 24—24 of FIG. 16.
Figure 25:
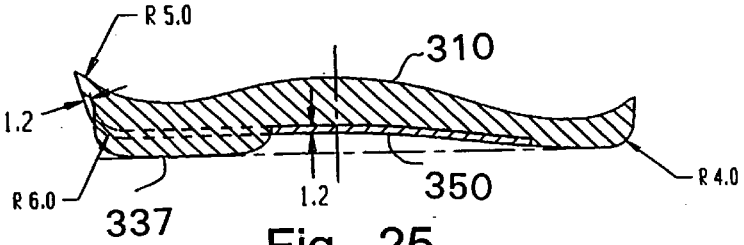
FIG. 25 is diagrammatic cross-sectional view along section line 25—25 of FIG. 16.
Figure 26:
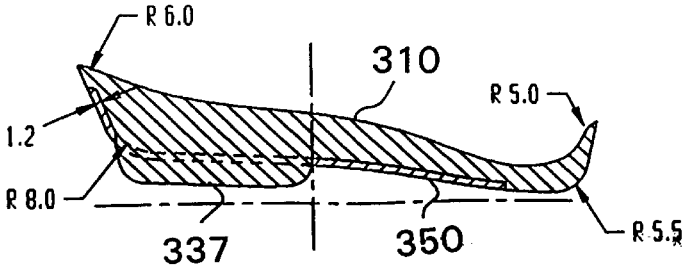
FIG. 26 is diagrammatic cross-sectional view along section line 26—26 of FIG. 16.
Figure 27:
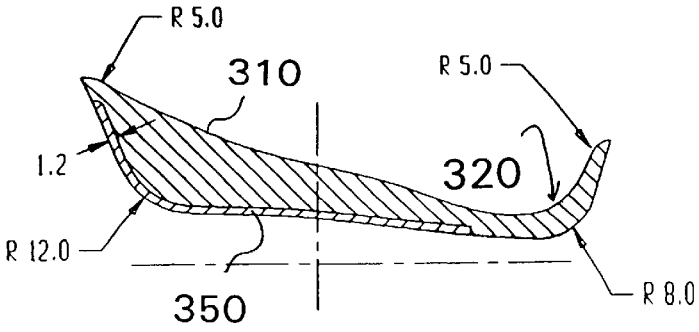
FIG. 27 is diagrammatic cross-sectional view along section line 27—27 of FIG. 16.
Figure 28:
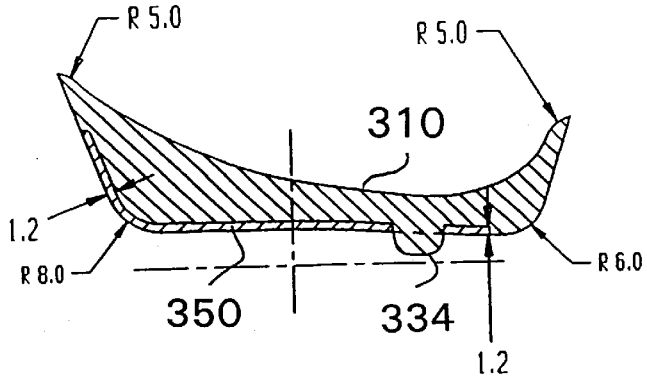
FIG. 28 is diagrammatic cross-sectional view along section line 28—28 of FIG. 16.
Figure 29:
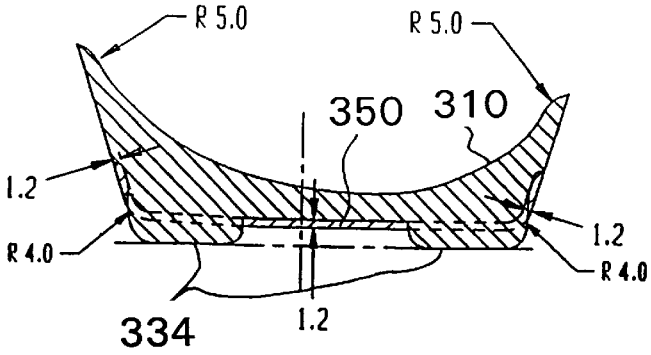
FIG. 29 is diagrammatic cross-sectional view along section line 29—29 of FIG. 16.
Figure 30:
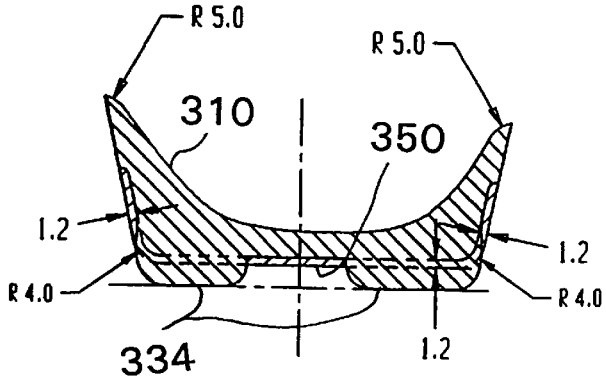
FIG. 30 is diagrammatic cross-sectional view along section line 30—30 of FIG. 16.
Figure 31:
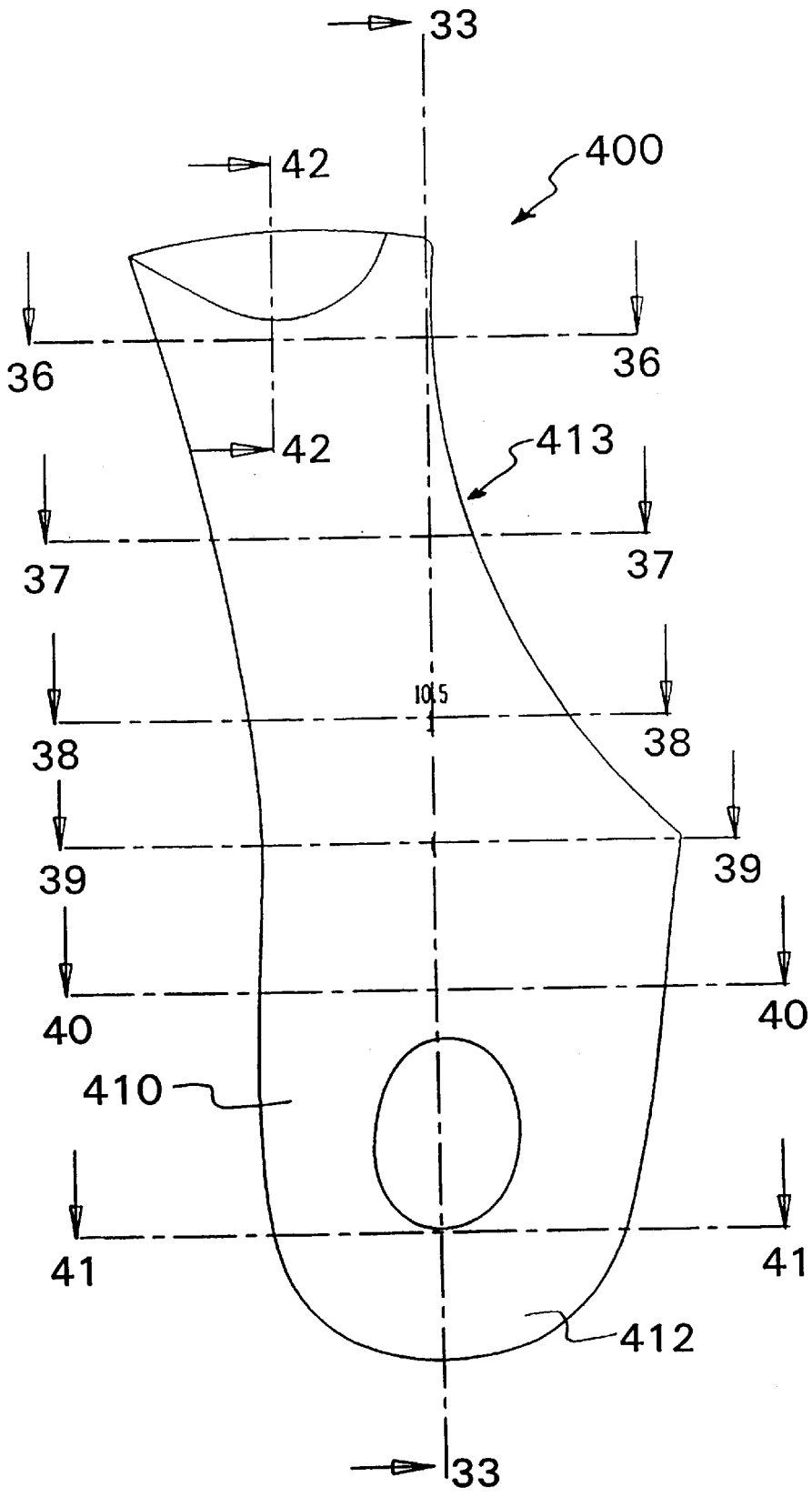
FIG. 31 is diagrammatic bottom plan view of a third embodiment showing the most simplified form for the sole assembly according to the present invention.
Figure 32:
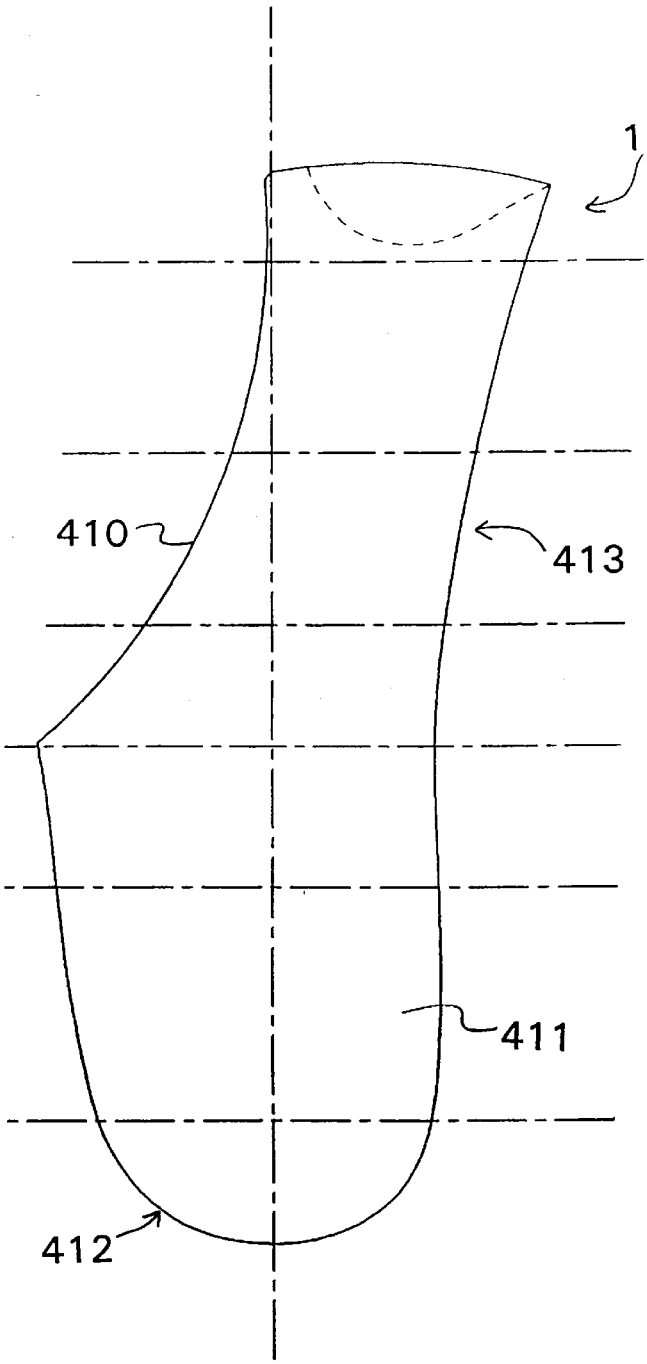
FIG. 32 is diagrammatic top plan view of FIG. 31.
Figure 34:
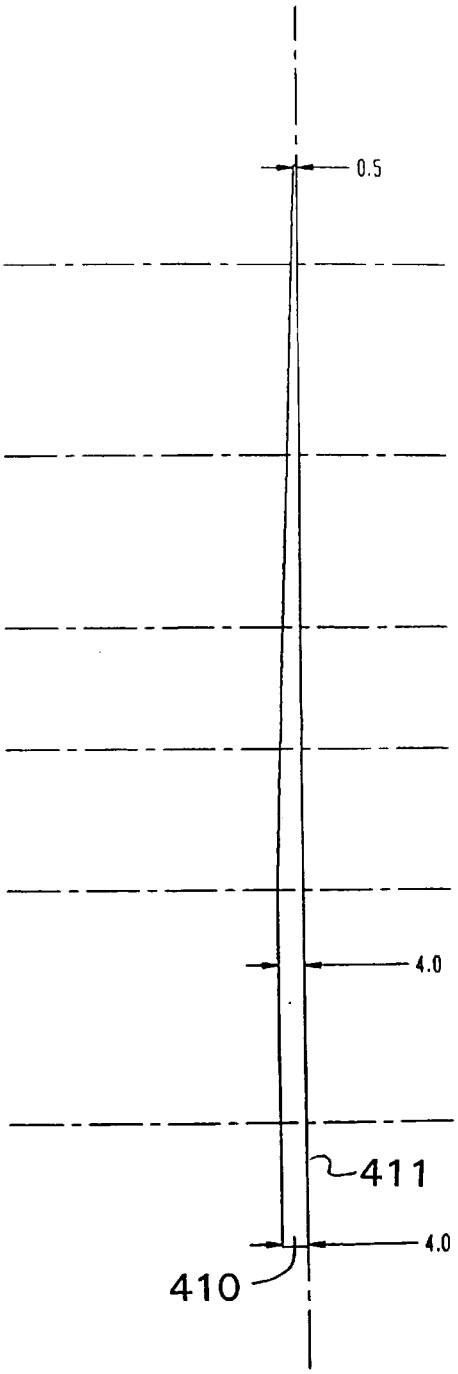
FIG. 34 is diagrammatic inner side elevational view of FIG. 31.
Figure 35:
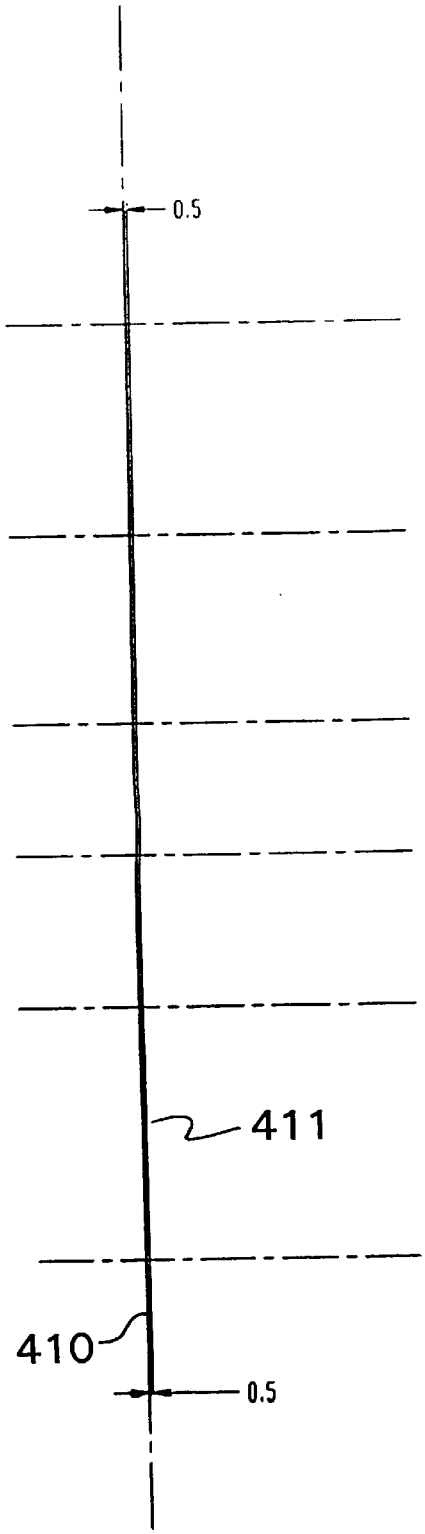
FIG. 35 is diagrammatic outer side elevational view of FIG. 31.
Figure 33:
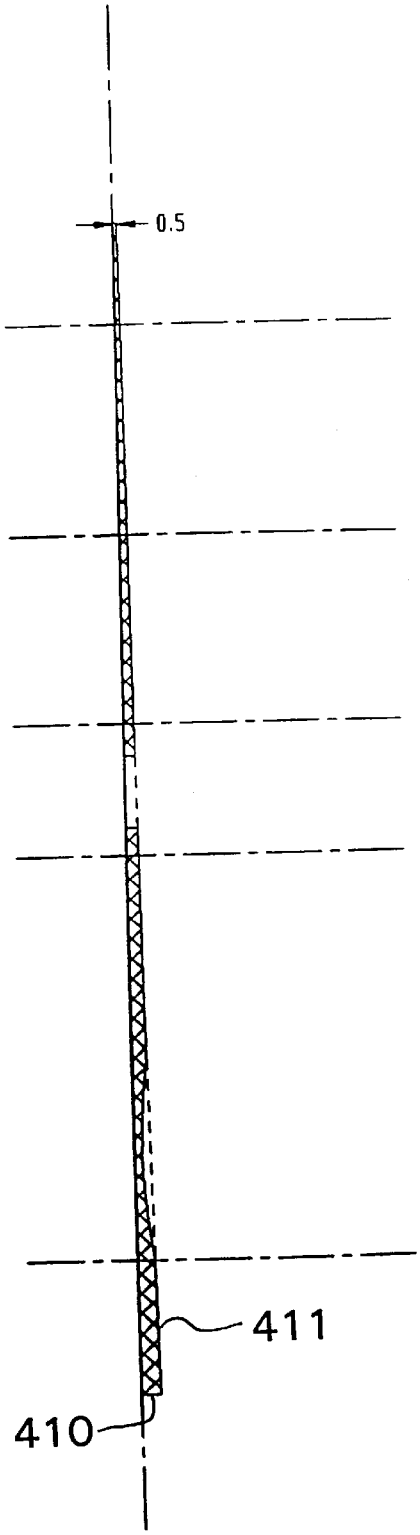
FIG. 33 is diagrammatic cross-sectional view along section line 33—33 of FIG. 31.
Figure 36:
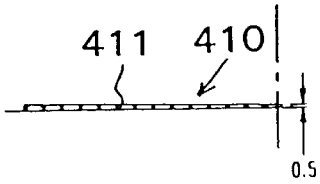
FIG. 36 is diagrammatic cross-sectional view along section line 36—36 of FIG. 31.
Figure 37:
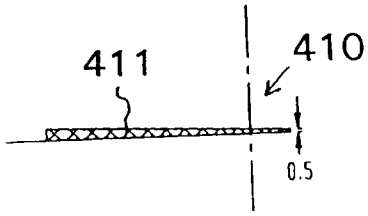
FIG. 37 is diagrammatic cross-sectional view along section line 37—37 of FIG. 31.
Figure 38:
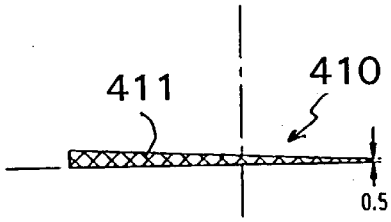
FIG. 38 is diagrammatic cross-sectional view along section line 38—38 of FIG. 31.
Figure 39:
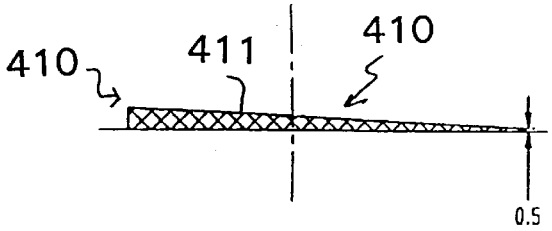
FIG. 39 is diagrammatic cross-sectional view along section line 39—39 of FIG. 31.
Figure 40:
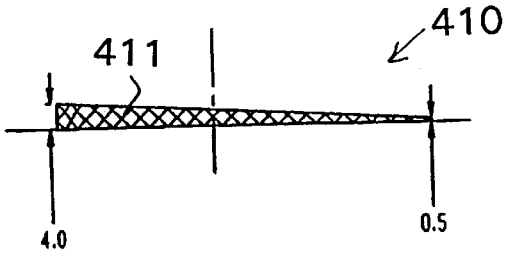
FIG. 40 is diagrammatic cross-sectional view along section line 4040 of FIG. 31.
Figure 41:
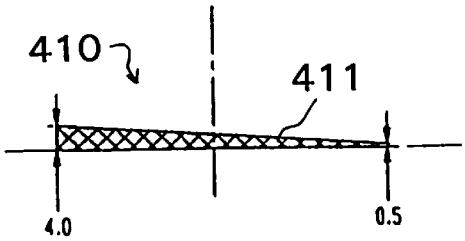
FIG. 41 is diagrammatic cross-sectional view along section line 41—41 of FIG. 31.
Figure 42:
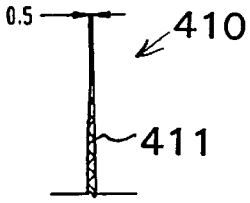
FIG. 42 is diagrammatic cross-sectional view along section line 42—42 of FIG. 31.

The body 310 includes a plurality of heel protrusions 234, e.g., three heel protrusions, which extend around and radially about the periphery of the foot bed heel portion 231 (FIG. 16). The plurality of foot bed heel protrusions 234 each have a flat end face 335 (FIG. 19). The first plurality of foot bed protrusions 334 do not overly either the first or third foot bed suspension zones 320, 322. All of the heel protrusions 334 can have identical physical properties or characteristics. Alternatively, the heel protrusion(s) 334 located on the inner side of the sole can be manufactured from a harder material while the heel protrusion(s) 334 located on the outer side of the sole can be manufactured from a softer more resilient material. The softer more resilient material will assist the foot in follow its normal walking path and avoid early pronation of the foot.

A plurality of foot bed arch protrusion 237, e.g., two sequentially arranged arch protrusions, are located on the inner side of the foot bed arch portion. All of the arch protrusions 337 can have identical physical properties or characteristics. Alternatively, the arch protrusion 337 located toward the forward portion of the sole can be manufactured from a softer more resilient material while the arch protrusion 337 located adjacent the heel portion of the sole can be manufactured from a softer material. The softer more resilient material will assist with a gentle lowering of the arch.

All of the heel and arch protrusions 334, 337 extend downwardly away from a base of the foot bed frame assembly 330. The outer side of the forward portion 314 of the foot bed frame assembly 330 includes a plurality of foot bed tabs 338 while the inner side thereof includes a diving board or toe off lever 339.

The foot bed composite 350 is generally a rigid assembly manufactured from nylon, TPU, or a composite fiber, for example. The foot bed composite 350 has a heel portion 351 and an arch portion 352 and possibly a forward portion (not shown). The composite heel portion 351 includes a plurality of heel openings 353 corresponding in size, shape and location to receive the heel protrusions 334. The composite arch portion 352 includes a plurality of arch openings 354 corresponding in size, shape and location to receive the plurality of arch protrusions 337. It is to be appreciated that the foot bed composite 350 does not obstruct any of the suspension zones 320, 321, 322. The foot bed composite 330 may have a medial opening in the heel portion. The foot bed composite 350 is cambered upward to support the arch of the user.

The foot bed 300 may include a canting assembly (not shown) which includes two clips (not shown). The clips are structured to change a plane from heel lift plane. One clip is attached to the plurality of heel protrusions 334, e.g., the heel protrusion(s) located on the inner side of the sole, while the second clip is structured to attach to the arch protrusions 337. The two clips, once attached, combine with one another to form a plane that increases the spacing of the upper surface of the body heel portion 312 relative to a bottom of the shoe sole 300. That is, the foot bed 300 is generally flat at the second suspension zone 321 and thicker at the inner side of the heel. Preferably, the taper between the heel and the second suspension zone 321 for the first metatarsal head is between about 2 to 4 degrees.

The foot bed 300 is assembled as follows. The body 310 forms the uppermost top layer which is located to contact and engage with the wear's foot. The foot bed composite 350 is attached to the body 310 with the plurality of heel protrusions 334 extending through the plurality of heel openings 353 and the plurality of arch protrusions 337 extending through the plurality of arch openings 354. If desired or necessary, the canting assembly (not shown) is attached to the plurality of heel protrusions 334 and the arch protrusions 337. The main object is the canting assembly is to change the plane of the foot bed, starting with a lift of the heel that has a gradual angle that tapers longitudinally downward toward the front outer side of the sole such that there is virtually no lift behind the first metatarsal.

With reference to the conventional three phases of a step, with a transition between each of the three phases, the foot bed 300 operates as follows. The heel strikes first while the plurality of heel protrusions 334 flex to stabilize against posterior foot bed frame assembly arch portion 332 distortion, the heel shape centers between body first region 315 and second region 316 of the heel portion 312. The firm first region 315 stabilizes against early pronation while the soft second region 316 flexes forming the heel roll zone.

As the foot moves toward the stance phase, the plurality of heel protrusions 334 slope downward to a void in the posterior of the foot bed frame assembly arch portion 332. The tuberosity at the base of the fifth metatarsal head suspends into a semi firm body third region 317 forming the pocket of the first foot bed suspension zone 320. The suspension is maintained by the posterior void by plurality of heel protrusions 334 and the anterior void of the foot bed frame assembly arch portion 332 camber. Camber is created in the foot bed frame assembly arch portion 332 from the void between the height and angle of the most lateral section of the plurality of heel protrusions 334 and the most lateral anterior level transverse plane of the foot bed frame assembly arch portion 332. As the lateral foot suspends into the first foot bed suspension zone 320, the head of the first metatarsal suspends into a medial pocket of the second foot bed suspension zone 321. The first metatarsal head is suspended because the plurality of heel protrusions 334 are angled forward with an alteration in depth between the protrusions. As pressure is placed upon the plurality of heel protrusions 334, the plurality of heel protrusions 334 move down and forward with a spring effect forming the second foot bed suspension zone 321. During the stance phase, the medial and lateral suspension zones position the frame for least resistance to multiple foot shapes, and the mid-foot is cradled as it falls along a large convex soft fourth region 318.

As the foot moves towards the toe off phase, the most anterior lateral protrusion of the plurality of heel protrusions 334 maintain lateral suspension in first foot bed suspension zone 320 while the camber in the anterior lateral section of the foot bed frame assembly arch portion 332 flexes downward. The downward pressure moves to transfer medially as the fifth region 319 and medial frame toe off lever 339 resist compression, the medial transfer moves center tabs of the medial mid section of anterior frame section, including the foot bed tabs 338, downward. This stabilizes the fold zone 307 between the anterior lateral frame section levers and the medial toe off lever 339. The materials of the anterior frame sections are semi rigid, rigid type materials of TPU, nylon type.

During the toe off phase, the medial portion of the plurality of heel protrusions 334 flex downward and angle forward, this supports the anterior section of the medial arch, while suspending the lateral section of the medial arch along a frame void adjacent to third foot bed suspension zone 322. The third foot bed suspension zone 322 allows the lateral arch to adjust the flexion of the soft body of second region 316 and semi firm body third region 317. The lateral arch suspension zone allows the foot to engage the toe off sequence without resistance to the natural path of the foot from the frames. At toe off, the first metatarsal head rolls forward on the second foot bed suspension zone 321, the zone is suspended between the engaged plurality of heel protrusions 334 and the anterior toe off lever 339. The first metatarsal head flexes the base of the fold zone toe off lever 339 to release all posterior frame compression for a stabilized and controlled toe off.

With reference to FIGS. 31–42, a fourth and simplest embodiment of the reactive upper sole, according to the present invention, will now be described. According to this embodiment, the reactive upper sole includes a foot bed 400 that is structured to be placed on top of a first frame assembly 40 and the second frame assembly for ward portion 53. The foot bed 400 is an insert that is structured to cooperate with the e.g., and mid sole and an outer sole (not shown). The characteristic features of the foot bed 400 may be changed by changing the materials used for manufacture of the foot bed 400 and altering the number and/or location of the various components.

The foot bed 400, according to this embodiment, which typically comprises an upper body, a foot bed frame assembly, and a foot bed composite all combined in all single upper body and frame assembly 410. The combined upper body and frame assembly 410 is generally shaped as an insole having a plurality of regions. The regions can be manufactured from different materials, or different compositions of a single material, so that each region has a specific resiliency. The combined upper body and frame assembly 410 has an upper surface 411 and a bottom surface. Some regions of the body may overlie other regions of the other components of the foot bed 400 as described below in further detail.

The combined upper body and frame assembly 410 includes a heel portion 412 and an arch portion 413. The foot bed 400 has an inner side and an outer side corresponding to the inner and outer sides of a human foot. The elongate side of the sole 1 that is structured to contact a user's big toe is referred to as the "inner" side of the sole 1, and the elongate side of the sole that is structured to contact the user's little toe is referred to as the "outer" side. A first region 415, located at the inner side of the foot bed heel portion 412, is manufactured from a firm material, such as EVA.

The combine upper body and frame assembly 410 forms the uppermost top layer which is located to contact and engage with the wearer's foot while a bottom surface of the combined upper body and frame assembly 410 engages with the outer sole. The main object of the sole of this embodiment is to provide a foot bed which has the greatest heel lift along the rear most area and inner side of the heel portion 412. The thickness of the foot bed 400 gradually tapers or feathers to a minimal thickness of about 0.5 mm at both the outer side of the heel portion 412 and the forward most outer side of the arch portion 413, adjacent the first metatarsal head, such that there is virtually no lift behind the first metatarsal.

With reference to the conventional three phases of a step, with a transition between each of the three phases, the foot bed 400 operates as follows. The heel strikes first while the heel portion 412 of the combined upper body and frame assembly 410 centers and stabilizes against early pronation and assists with heel roll zone as discussed above.

Figure 45:
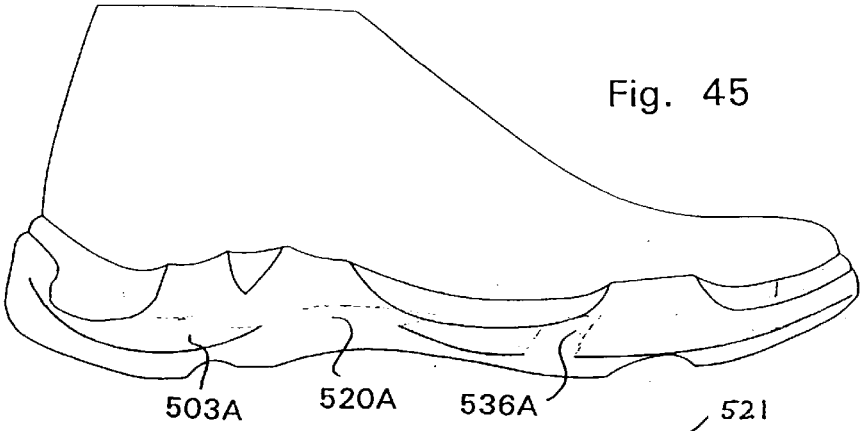
FIG. 45 is diagrammatic inner side elevation view of the fifth embodiment for the left foot.
Figure 43:
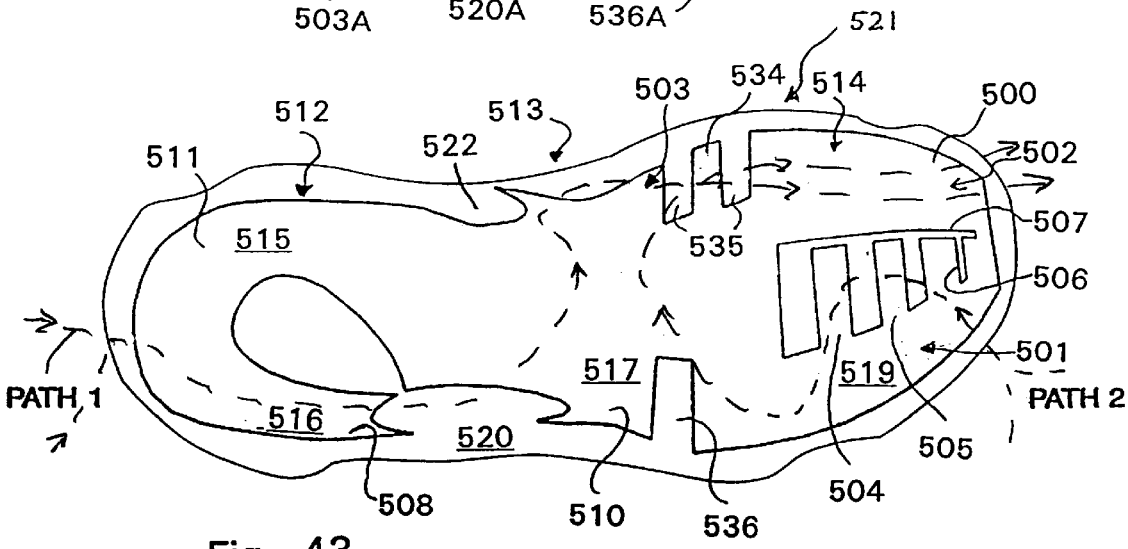
FIG. 43 is diagrammatic top plan view of a fifth embodiment for the sole assembly with the inner sole performing some of the structural characteristics of the mid sole.
Figure 44:
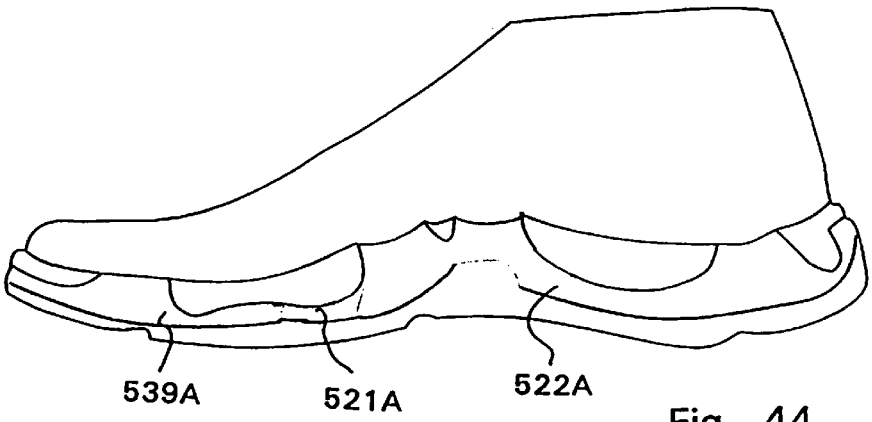
FIG. 44 is diagrammatic inner side elevation view of the fifth embodiment of FIG. 43 for a right foot.

With reference to FIGS. 43–45, a fifth embodiment of the reactive upper sole, according to the present invention will now be described. According to this embodiment, the reactive upper sole includes a foot bed 500 that is structured to function as the mid sole and may be used in combination with one or more frame assemblies as with the previous embodiments, e.g., the foot bed 50 may be placed on top of a first frame assembly and a second frame assembly forward portion. The foot bed 500 is an insert that is structured to cooperate with the outer sole. The characteristics features of the foot bed 500 may be changed by changing the materials used for manufacture of the foot bed 500 and altering the number and/or location of the various components.

The foot bed 500 includes a plurality of folding directional levers 501, 502, 503. The first lever 501 extends longitudinally on the outer side of the forward portion of the sole. The second lever 502 extends longitudinally on the inner side of the forward portion. The third levers 503 extend, generally, perpendicular to a longitudinal axis of the foot bed 500 at the arch portion 513. An upper body 510 links the folding directional levers 501, 502, 503 that help the foot control the shoe throughout the toe off phase. The fore foot engages a first anterior lateral directional lever 501 that alters in angle to move the medial lever tabs 504, 505, 506 at downward angles along front and rear weak zones forming a longitudinal medial fold zone 507 located approximately between the big toe and the second toe and extending longitudinally to the ball of the foot. This movement structures a medial directional lever 502 that extends longitudinally bordered by the guiding support of the fold zone. Posterior to the medial directional lever 502 and an anterior medial arch wrap directional lever 503 are levered by the plantar protrusions that alter in depth allowing the first metatarsal to move and angle the anterior metatarsal head along the suspension 521 (described below). This allows the posterior metatarsal and anterior toe to an uninterrupted off phase positioning. The downward lever action of the anterior medial arch moves and stabilizes the medial directional lever 502 upward as it supports the front of the medial arch in motion to the toe off phase. These folding directional levers 501, 502, 503 may extend the full length of the foot bed 500. These directional levers 501, 502, 503 cooperate with the directors in the second frame assembly. Thus, the user's foot activates levers in the foot bed 500 which act on the directors in the second frame assembly which, in turn, act on the outer sole 10.

The foot bed 500, according to this embodiment, includes a single layer, namely, the upper body 510 which has softer areas and more firmer areas. In some applications, the foot bed 500 may includes additional layers. It is to be appreciated that there may be less layers or the various layers may be combined with one anther to form an integral and unitary structure. The upper body 510 is generally shaped as an insole having a plurality of regions manufactured from different materials, or different compositions of a single material, so that each region has a specific resiliency. The upper body 510 has an upper surface 511 and a bottom surface. Some regions of the body may overlie other regions of the other components of the foot bed 500 as described either above or below in further detail.

The upper body 510 includes a heel portion 512, an arch portion 513, and a forward portion 514 (FIG. 3). The foot bed 500 has an inner side and an outer side corresponding to the inner and outer sides of a human foot. The elongate side of the sole 1 that is structured to contact a user's big toe is referred to as the "inner" side of the sole 1, and the elongate side of the sole that is structured to contact the user's little toe is referred to as the "outer" side. A first region 515, located at the inner side of the foot bed heel portion 512, is manufactured from a firm material. A second region 516, located at the outer side of foot bed heel portion 512, comprises a lever arm 508 which terminates at a remote free end 509 and is typically manufactured from the same material. The free end 509 of the lever arm 508, which is unattached to a remainder of the upper body 510, assists with downward flexing of the lever arm 508 toward the outer sole 10 when gaiting pressure from the foot is applied to the upper body 510 during heel strike and in essence renders this area "softer" then a remainder of the heel portion 512. A third region 517, extending from the heel portion 512 over the arch portion 513 along the inner side of the forward portion 514 and along the outer side of the sole, is manufactured firm material, such as EVA. A final region 519, located on the outer side of foot bed forward portion 514, is also manufactured firm material, such as EVA. The upper body 510, according to this embodiment, is provided with a plurality of relief areas to render certain areas of the upper body 510 less firm than a remainder of the upper body 510. The relief area accommodate a material, such as, which is more resilient than a remainder of the upper body 510.

A first foot bed suspension zone 520 is provided on the outer side of the foot bed arch portion 513. The first foot bed suspension zone 520 is first void provided in the third region 517, e.g., the first void is filled with a "more resilient" material to render this area softer than a remainder of the sole assembly. A second foot bed suspension zone 521, formed by a single piano key 534 extending from a remainder of the upper body 510, is located on the inner side between the foot bed arch portion 513 and the foot bed forward portion 514. A third foot bed suspension zone 522, is a smaller void located on the inner side, between the foot bed heel portion 512 and the foot bed arch portion 513, e.g., the second void is also filled with a "more resilient" material to render this area softer than a remainder of the sole assembly. The two opposed latter sides of the single piano key 534 are spaced from remainder of the upper body 510 by gaps 535 and the gaps 535 are filled with a softer material. The single piano key 534 and associated gaps 535 in the upper body 510 facilitate bending or flexing of the single piano key 534 downward toward the outer sole when walking pressure from the foot is applied to the upper body 510 to render this area softer than a remainder of the shoe sole. An outer side lateral edge, opposite to the single piano key 534, has a cut out or notch 536 formed therein, e.g., the cut out or notch is filled with a "more resilient" material to render this area softer than a remainder of the sole assembly. Each of the suspension zones tend to be softer areas than the remainder of the foot bed 500.

The foot bed 500 may possibly include a canting assembly (not shown), such as a pair of clips that are structured to change a heel lift plane. The two clips, once attached, combine with one another to form a plane that tapers to increase the spacing of the upper surface of the body heel portion 512 relative to remainder of the shoe sole. That is, the foot bed 500 is generally flat at the second suspension zone 521 and thicker at the inner side of the heel such that a taper between the heel and the second suspension zone 521, for the first metatarsal head, is between about 2 to 4 degrees.

The upper body 510 forms the uppermost top layer which is located to contact and engage with the wear's foot and is positioned over the outer sole (not shown). If desired or necessary, one or more conventional frames and/or a mid sole (only diagrammatically shown in FIGS. 43–54) may be located between the upper body 510 and the outer sole 10. In addition, a canting assembly, for changing a plane of the foot bed 500, starting with a lift of the heel that gradually tapers longitudinally downward toward the front outer side of the sole such that there is virtually no lift behind the first metatarsal, may be employed.

With reference to the conventional three phases of a step, with a transition between each of the three phases, the foot bed 500 operates as follows. The heel strikes just to the outside of center of the heel portion and this commences compression of the lever arm 508 and roll of the foot toward the outer side of the foot bed 500. The firm first region 515 stabilizes the foot against early pronation while of the lever arm 508 (i.e. the soft second region 516) flexes downward forming the heel roll zone.

As the foot moves toward the stance phase, the tuberosity of the base of the fifth metatarsal head suspends into a semi firm body third region 517 forming the pocket of the first foot bed suspension zone 520. Downward suspension of the fifth metatarsal tuberosity forces a lateral mid-section of the shoe sole, slightly medial of the fifth metatarsal head, to tilt downward toward the lower shoe sole and such tilting action torques and forces the opposite inner side of the arch portion 513, e.g., at the forward portion of the arch section 513 and the single piano key 534, to tilt upward away from the outer shoe sole. The single piano key 534 and the single cutout or notch 536 provide a pair of opposed relief areas which assist with torqueing of a central region of the foot bed 500 as the fifth metatarsal head suspends in the third region 517. As the lateral foot suspends into the first foot bed suspension zone 520, the head of the first metatarsal suspends into a medial pocket of the second foot bed suspension zone 521. During the stance phase, the medial and lateral suspension zones position the frame for least resistance to multiple foot shapes, and the mid-foot is cradled.

As the foot moves from the stance phase towards the toe off phase, the sole flexes and releases the downward pressure from the lever arm 508 and the release pressure flows toward inwardly toward the inner side of the sole and then forward toward the medial the second region 517 and a toe off lever 539, as depicted by path P1.

During such transision, the fifth metatarsal continues to flex further downward toward the outer sole 10 compressing posterior transverse director frame section, located beneath the fifth metatarsal, while an oppose anterior frame is biased upward away from the outer sole and torques inward, toward the outer side, along the fold zone 507 following a second transfer path P2. During this transfer phase, as the sole flexes, the posterior lateral frame torques both downward, toward the outer sole, and outward toward the outer side of the sole while an anterior lateral frame moving upward torques inward as the sole compresses. The inward torque transfer the foot's shoe control medially and the posterior medial frame, between the forward most region of the arch portion 513 and the single piano key 534, maintains an upward support or force as the posterior and lateral compresses downward toward the outer sole. The single piano key 534 and the medial posterior frame flex downward toward the outer sole as the anterior medial frame anterior compress inward.

During the toe off phase, all of the energy from paths P1 and P2, generate within the sole, are combined with one another and release from the shoe sole. As the foot moves forward, medially toward toe off, a void in the medial frame, beneath the third suspension zone 522, allows the foot to pronate between first and third suspension zones 520 and 522 with support from the frame section. The ball of the first metatarsal head pushes the second suspension zone 521 posterior frame downward with a constant upward support pressure from an anterior and the diving board 539 and any support structure or fame located beneath the diving board 539.

At toe off, the ball of the first metatarsal head rolls forward compressing the single piano key 534, and the frame located beneath the single piano key 534, and the diving board 539, and the frame located beneath diving board 539, releasing the posterior pressure on from the foot bed 500 for an energetic, stabilized and controlled toe off. Once this occurs, the foot bed 500 and the frame(s) supporting the foot bed 500, return to their original state for a subsequent heel strike.

Figure 48:
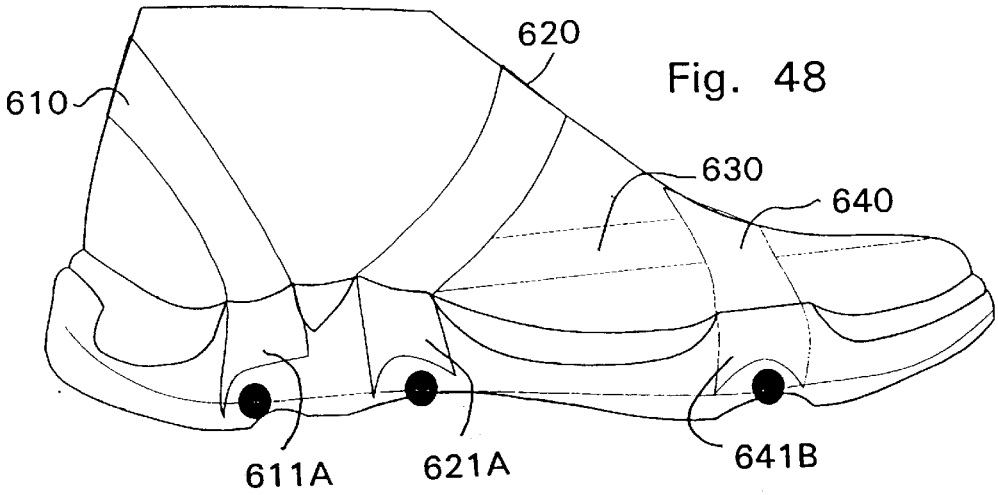
FIG. 48 is diagrammatic inner side elevation view of the sandal for the left foot.
Figure 46:
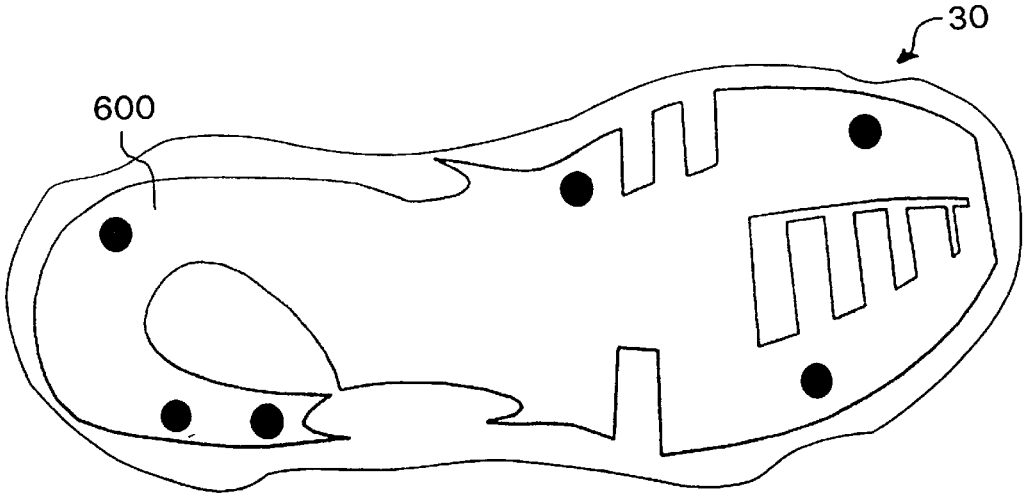
FIG. 46 is diagrammatic top plan view of a fifth embodiment with the inner sole performing some of the structural characteristics of the mid sole.
Figure 47:
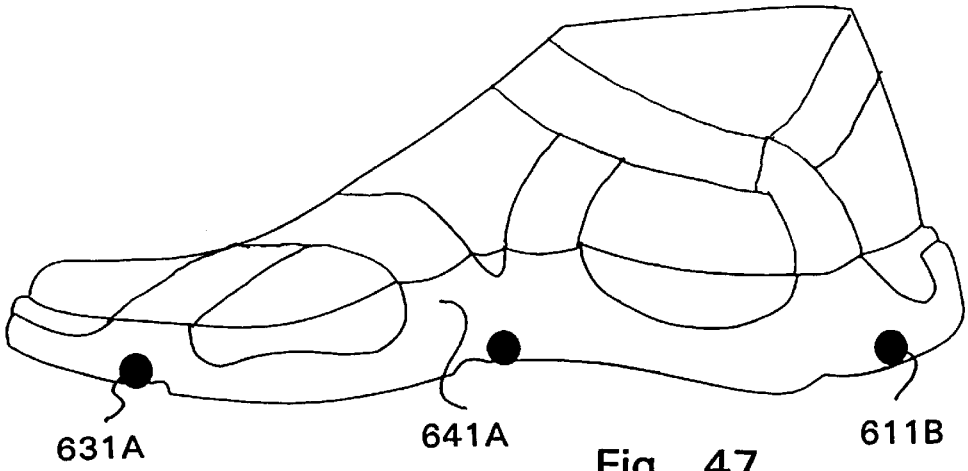
FIG. 47 is diagrammatic inner side elevation view of the sandal of FIG. 43 for the right foot.

As shown in FIGS. 46–48, the reactive upper sole assembly 30 and the foot bed 600 may be further enhanced when used as the sole of a shoe that moves selected zones of attached upper material, the display shows the concept as a sandal 600. The sandal 600 adds additional control functions which act through straps 610, 620, 630, 640 (only diagrammatically shown). The straps 610, 620, 630 and 640 interact with the wear's foot to control the reactive upper sole 30, the foot bed 600, and/or the outer sole assembly. The straps 610, 620, 630 and 640 also act as a positioning system, the straps position to border the plantar pockets formed by suspension zones, the straps 610, 620, 630 and 640 and material link to frame connection locations allowing structured side pockets and flex zones that align with the plantar pockets, flex and suspension zones. This forms a positioning pocket that forms to multiple foot strictures that need positioning of the shoes upper wall, as well as suspension positioning on its plantar base. That is, the wear's foot, which may have many different shapes, is moved to the proper position on the reactive upper sole 30 or foot bed 600. The positioning system includes a plurality of pockets and flex zones around the first metatarsal and the fifth metatarsal. These pockets and flex zones center the wear's foot on the reactive upper sole 30 or foot bed 600. Similarly, shoes can be programmed with upper lacing systems that pull fabric around the pocket suspension zone borders. The fabric attaches to the reactive sole assembly 30 at locations that move the fabric away from interference of foot positioning as the frame directors and flexors alternate the shoe upper by tightening and loosening zones during foot guidance during the gait cycle. The remote ends, of external fabrics or straps for a sandal, can be secured or connected to internal programmed moving structures of the shoe sole so that as the moving structures move toward or away from the outer sole, for example, as a result of the foot guiding the shoe sole during a gait or stride, the external fabric or strap moves in a corresponding upward or downward direction to either increase or decrease the securing tension that the external fabric or strap exerts on the foot.

As can be seen if FIGS. 46–48, the footbed of the fifth embodiment is incorporated into a sandal. The first strap 610 has a first end attached at 611A to an inner side of the heel portion and a second end extends around the rear portion of the heel of a user and is attached to an outer side (not shown) of the heel portion 612. A second strap 620 has a first end attached on the inner side at 621A of the heel portion 612, slightly forward of the first attachment point 611A. The strap 620 crosses over the front portion of the ankle and a second end thereof attached to the first strap 610 adjacent the attachment point of the first strap 610 to the outer side of the heel portion 612. A third strap 630 has a first end attached to the outer side of the forward portion 614 and a second end extends over the foot and is attached to the attachment location 621A for the second strap 620 adjacent inner side of the heel portion 612. A fourth strap 640 has a first end attached at 641A to an inner side of the sole and a second end extends over the foot and crosses the third strap 630. A second end of the fourth strap 640 is attached to the second strap 620 adjacent to the attachment point 621A of the second strap 620 to the inner side of the heel portion 612. By attaching the straps 610, 620, 630 and 640 to movable components of the footbed, mid sole and/or lower sole, the straps 610, 620, 630 and 640 can be suitably tightened or loosened, as necessary, as the foot guides the shoe sole to provide added comfort to the wearer of the sandals 600.

The sole assembly provides a basic structure for the foot to guide a shoe sole in such a way the reduces the internal and external shearing that can occur. The shearing can alter many things, including performance, comfort and the foot's natural ability to move along multiple paths. The present invention is directed a providing footwear which facilitates the foot following in natural gait path. That is, the present invention provides an improved sole assembly which can be enhanced by programming the sole structures to work with, and not against, the foot.

The mid sole can be structured with two guidance structures, one for the upper surface closest to the foot, and one for the lower surface closest to the outer sole. The foot can then move the upper mid sole sections that move the lower mid sole sections and the outer sole sections. This results in a bi-frame sole structure.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of present invention which is to be given the full breadth of the claims appended and any and all equivalents thereof.

What is claimed is:

1. An internal midsole assembly for a shoe comprising:

a frame assembly having a bottom surface and an upper surface for supporting a foot, the frame assembly comprising at least a heel portion and an arch portion having a medial arch portion and a lateral arch portion; and the lateral arch portion of the frame assembly having a tuberosity suspension zone for receiving and suspending a tuberosity of a base of a fifth metatarsal bone, remote from a head thereof, of a wearer during use of the internal midsole assembly, and the tuberosity suspension zone being a relatively softer area than an area of the frame assembly bordering the tuberosity suspension zone;

wherein the bottom surface of the frame assembly has a plurality of protrusions extending therefrom with at least one of the plurality of protrusions being located in the heel portion to facilitate providing lift to a foot of a wearer and at least one to the plurality of protrusions being located in an anterior region of the medial arch portion; the at least one protrusion in the heel portion and the at least one protrusion in an anterior section of the arch portion forming an arch suspension region therebetween for supporting a medial arch of a foot of a wearer;

a front anterior medial arch portion having a plurality of sequentially arranged medial arch protrusions, each of the plurality of sequentially arranged medial arch protrusions elongate with a longitudinal axis extending generally perpendicular to the inner side of the internal midsole assembly;

a first medial arch protrusion located closest to a forward most portion of the internal midsole assembly extending downward and having a bottom surface which is substantially coincident with a plane defined by a base of the internal midsole assembly; and a last medial arch protrusion located closest to the heel portion extending downward toward but having a bottom surface which is spaced further away from the plane defined by the base of the internal midsole assembly, the first and the last medial arch protrusions facilitating a gently lowering of the front anterior arch of the foot during use of the internal midsole assembly.

2. The internal midsole assembly according to claim 1, wherein the bottom surface of the medial arch portion of the frame assembly has a plurality of protrusions extending therefrom with at least one of the plurality of protrusions being located in the heel portion adjacent the tuberosity suspension zone to facilitate suspending the tuberosity of the base of the fifth metatarsal bone, remote from the head thereof, of the wearer by the tuberosity suspension zone during use.

3. The internal midsole assembly according to claim 1, wherein the first medial arch portion protrusion and the forward portion facilitate suspending a forward region of the internal midsole assembly from a remainder of the internal midsole assembly to accommodate the first metatarsal during use of the internal midsole assembly.

4. The internal midsole assembly according to claim 1, wherein the frame assembly includes a rigid frame, the rigid frame contoured in a heel portion thereof, so as to wrap around the outer side of a heel of the wearer with the rigid frame tapered on an inner side of the heel portion, adjacent a posterior medial arch, so as to avoid wrapping a rear portion of the medial arch.

5. The internal midsole assembly according to claim 1, wherein:

the heel portion has a plurality of heel protrusions which are located around a periphery of the heel portion and extend radially with respect to the heel portion; and each of the heel protrusions has a flat radially outer area.

6. The internal midsole assembly according to claim 1, wherein:

the heel portion has a plurality of heel; and all of the heel protrusions have substantially identical compression characteristics.

7. The internal midsole assembly according to claim 1, wherein the heel portion has a plurality of heel protrusions, and the heel protrusions located on an inner side of the internal midsole assembly are manufactured from a harder material relative to the heel protrusions located on an outer side of the internal midsole assembly, which are manufactured from a softer, more resilient material, to resist early pronation of the foot.

8. The internal midsole assembly according to claim 1, further comprising;

a second medial arch protrusion, located between the first and the last medial arch protrusions, extending downward toward but having a bottom surface which is spaced away from the plane defined by the base of the internal midsole assembly by a distance less than a spacing distance of the last medial arch protrusion, the first, the second and the last medial arch protrusions facilitating a gently lowering of the arch during used of the internal midsole assembly.

9. The internal midsole assembly according to claim 1, wherein the front portion of the sole assembly has a void zone which extends substantially parallel to a longitudinal axis of the sole assembly, the void zone separating a first lever which extends longitudinally along an outer side of the internal midsole assembly from a second lever which extends longitudinally along an inner side of the internal midsole assembly, with the second lever oriented for engagement with a first metatarsal head of a foot of a wearer during use.

10. The internal midsole assembly according to claim 1, wherein remaining metatarsal heads of the foot of the wearer engage with the first lever during use.

11. The internal midsole assembly according to claim 1, wherein the frame assembly includes a rigid frame, the rigid frame assembly further including a forward portion having an upper surface for supporting a foot and a bottom surface, the bottom surface of the forward portion of the internal midsole assembly being devoid of any protrusion whereby the at least one medial arch portion protrusion is a forward most protrusion of the internal midsole assembly.

12. The internal midsole assembly according to claim 11, wherein:

a portion of the bottom surface of the arch portion of the internal midsole assembly is cambered to support a transverse arch of the wearer during use; and a central region of the upper surface of the arch portion is convex, the convex upper surface being relatively soft to cradle a foot of the wearer as the foot engages therewith during use of the internal midsole assembly.

13. The internal midsole assembly according to claim 11, wherein:

the frame assembly includes a rigid frame, the rigid frame tapered in thickness from the heel portion to the arch portion at an angle of between about 2 to about 4 degrees; and the rigid frame tapers in thickness from the inner side to the outer side.

14. The internal midsole assembly according to claim 1, wherein a first medial arch portion protrusion is located adjacent a region of the internal midsole assembly which accommodates a first metatarsal head of the wearer of during use, the first medial arch portion protrusion being a forward most protrusion of the internal midsole assembly.

15. The internal midsole assembly according to claim 1, wherein a central region of the upper surface of the arch portion is relatively soft and convex to facilitate cradling of a foot of the wearer as the foot engages therewith during use of the internal midsole assembly.

16. The internal midsole assembly according to claim 1, wherein the internal midsole assembly is incorporated in a shoe, the shoe having an outer sole, and the internal midsole assembly assists with the foot of the wearer guiding the outer sole during a gait of the wearer of the shoe.

17. The internal midsole assembly according to claim 16, wherein the internal midsole assembly is readily replaceable with a second internal midsole assembly which has different characteristics to facilitate changing performance characteristics of the internal midsole assembly by the user.

18. The internal midsole assembly according to claim 16, wherein at least one of the plurality of protrusions of the internal midsole assembly engages with the outer sole to change one of an angle and a position of an external protrusion of the outer sole to facilitate improving desired traction of the outer sole.

19. The internal midsole assembly according to claim 18, wherein at least one frame is provided between the internal midsole assembly and the outer sole to facilitate the foot guiding the outer sole during the gait of the wearer of the shoe.

20. An internal midsole assembly for a shoe comprising:

a frame assembly having a bottom surface and an upper surface for supporting a foot, the frame assembly comprising at least a heel portion and an arch portion having a medial arch portion and a lateral arch portion; and the lateral arch portion of the frame assembly having a tuberosity suspension zone for receiving and suspending a tuberosity of a base of a fifth metatarsal bone, remote from a head thereof, of a wearer during use of the internal midsole assembly, and the tuberosity suspension zone being a relatively softer area than an area of the frame assembly bordering the tuberosity suspension zone the bottom surface of the frame assembly has a plurality of protrusions in the medial arch portion, the internal midsole assembly further including an arch clip structured for engaging with the plurality of protrusions in a front anterior medial arch of the medial arch portion to change lowering characteristics of the arch section; and the bottom surface of the frame assembly has a plurality of protrusions in the heel portion, the internal midsole assembly further including a heel clip structured for engaging with the plurality of protrusions in the heel portion to facilitate canting of the internal midsole assembly.

21. The internal midsole assembly according to claim 20, wherein:

the arch clip is removably attached to the plurality of protrusions of the medial arch portion; and the heel clip is removably attached to the plurality of protrusions of the heel portion.

22. An internal midsole assembly for a shoe comprising: a frame assembly having a bottom surface and an upper surface for supporting a foot, the frame assembly comprising at least a heel portion and an arch portion having a medial arch portion and a lateral arch portion; and the lateral arch portion of the frame assembly having a tuberosity suspension zone for receiving and suspending a tuberosity of a base of a fifth metatarsal bone, remote from a head thereof, of a wearer during use of the internal midsole assembly, and the tuberosity suspension zone being a relatively softer area than an area of the frame assembly bordering the tuberosity suspension zone;

wherein the bottom surface of the frame assembly has a plurality of protrusions extending therefrom with at least one of the plurality of protrusions being located in the heel portion to facilitate providing lift to a foot of a wearer and at least one to the plurality of protrusions being located in an anterior region of the medial arch portion; the at least one protrusion in the heel portion and the at least one protrusion in an anterior section of the arch portion forming an arch suspension region therebetween for supporting a medial arch of a foot of a wearer;

a front anterior medial arch portion having a plurality of sequentially arranged medial arch protrusions, each of the plurality of sequentially arranged medial arch protrusions elongate with a longitudinal axis extending generally perpendicular to the inner side of the internal midsole assembly;

each medial arch protrusions has substantially identical compression characteristics;

a forward edge of each medial arch protrusion is angled;

a forward most first medial arch protrusion, located closest to a forward most portion of the internal midsole assembly, is manufactured from a softer, more resilient material relative to a last medial arch protrusion, located closest to the heel portion, which is manufactured from a relatively harder material; and the first medial arch protrusion extends downward and has a bottom surface which is substantially coincident with a plane defined by a base of the internal midsole assembly while a last medial arch protrusion located closest to the heel portion extends downward toward but has a bottom surface which is spaced further away from the plane defined by the base of the internal midsole assembly, and the first and the last medial arch protrusions facilitating a gently lowering of the front anterior arch during use of the internal midsole assembly.

23. The internal midsole assembly according to claim 22, wherein the bottom surface of the medial arch portion of the frame assembly has a plurality of protrusions extending therefrom with at least one of the plurality of protrusions being located in the heel portion adjacent the tuberosity suspension zone to facilitate suspending the tuberosity of the base of the fifth metatarsal bone, remote from the head thereof, of the wearer by the tuberosity suspension zone during use.

24. The internal midsole assembly according to claim 22, wherein the first medial arch portion protrusion and the forward portion facilitate suspending a forward region of the internal midsole assembly from a remainder of the internal midsole assembly to accommodate the first metatarsal during use of the internal midsole assembly.

25. The internal midsole assembly according to claim 22, wherein the frame assembly includes a rigid frame, the rigid frame contoured in a heel portion thereof, so as to wrap around the outer side of a heel of the wearer with the rigid frame tapered on an inner side of the heel portion, adjacent a posterior medial arch, so as to avoid wrapping a rear portion of the medial arch.

26. The internal midsole assembly according to claim 22, wherein:

the heel portion has a plurality of heel protrusions which are located around a periphery of the heel portion and extend radially with respect to the heel portion; and each of the heel protrusions has a flat radially outer area.

27. The internal midsole assembly according to claim 22, wherein:

the heel portion has a plurality of heel; and all of the heel protrusions have substantially identical compression characteristics.

28. The internal midsole assembly according to claim 22, wherein the heel portion has a plurality of heel protrusions, and the heel protrusions located on an inner side of the internal midsole assembly are manufactured from a harder material relative to the heel protrusions located on an outer side of the internal midsole assembly, which are manufactured from a softer, more resilient material, to resist early pronation of the foot.

29. The internal midsole assembly according to claim 22, wherein the front portion of the sole assembly has a void zone which extends substantially parallel to a longitudinal axis of the sole assembly, the void zone separating a first lever which extends longitudinally along an outer side of the internal midsole assembly from a second lever which extends longitudinally along an inner side of the internal midsole assembly, with the second lever oriented for engagement with a first metatarsal head of a foot of a wearer during use.

30. The internal midsole assembly according to claim 22, wherein remaining metatarsal heads of the foot of the wearer engage with the first lever during use.

31. The internal midsole assembly according to claim 22, wherein the frame assembly includes a rigid frame, the rigid frame assembly further including a forward portion having an upper surface for supporting a foot and a bottom surface, the bottom surface of the forward portion of the internal midsole assembly being devoid of any protrusion whereby the at least one medial arch portion protrusion is a forward most protrusion of the internal midsole assembly.

32. The internal midsole assembly according to claim 1, wherein:

a portion of the bottom surface of the arch portion of the internal midsole assembly is cambered to support a transverse arch of the wearer during use; and a central region of the upper surface of the arch portion is convex, the convex upper surface being relatively soft to cradle a foot of the wearer as the foot engages therewith during use of the internal midsole assembly.

33. The internal midsole assembly according to claim 31, wherein:

the frame assembly includes a rigid frame, the rigid frame tapered in thickness from the heel portion to the arch portion at an angle of between about 2 to about 4 degrees; and the rigid frame tapers in thickness from the inner side to the outer side.

34. The internal midsole assembly according to claim 31, wherein a first medial arch portion protrusion is located adjacent a region of the internal midsole assembly which accommodates a first metatarsal head of the wearer of during use, the first medial arch portion protrusion being a forward most protrusion of the internal midsole assembly.

35. The internal midsole assembly according to claim 22, wherein a central region of the upper surface of the arch portion is relatively soft and convex to facilitate cradling of a foot of the wearer as the foot engages therewith during use of the internal midsole assembly.

* * * * *